US011540689B2

(12) United States Patent
Johnson et al.

(10) Patent No.: US 11,540,689 B2
(45) Date of Patent: Jan. 3, 2023

(54) SURFACE CLEANING APPARATUS WITH TWO-STAGE COLLECTION

(71) Applicant: BISSELL Inc., Grand Rapids, MI (US)

(72) Inventors: Steven M. Johnson, Hudsonville, MI (US); Jeffrey A. Scholten, Ada, MI (US)

(73) Assignee: BISSELL Inc., Grand Rapids, MI (US)

( * ) Notice: Subject to any disclaimer, the term of this patent is extended or adjusted under 35 U.S.C. 154(b) by 436 days.

(21) Appl. No.: 16/827,764

(22) Filed: Mar. 24, 2020

(65) Prior Publication Data

US 2020/0305672 A1 Oct. 1, 2020

Related U.S. Application Data

(60) Provisional application No. 62/825,079, filed on Mar. 28, 2019.

(51) Int. Cl.
*A47L 11/30* (2006.01)
*A47L 9/04* (2006.01)
(Continued)

(52) U.S. Cl.
CPC ..... *A47L 11/302* (2013.01); *A47L 9/0477* (2013.01); *A47L 9/2852* (2013.01); *A47L 9/2857* (2013.01); *A47L 11/24* (2013.01); *A47L 11/4008* (2013.01); *A47L 11/4011* (2013.01); *A47L 11/4016* (2013.01); *A47L 11/4061* (2013.01); *A47L 11/4066* (2013.01); *A47L 11/4088* (2013.01); *A47L 2201/04* (2013.01)

(58) Field of Classification Search
CPC .... A47L 11/302; A47L 9/0477; A47L 9/2852; A47L 9/2857; A47L 11/24; A47L 11/4008; A47L 11/4011; A47L 11/4016; A47L 11/4061; A47L 11/4066; A47L 11/4088; A47L 2201/04; A47L 11/085; A47L 11/145; A47L 11/185; A47L 11/4041; A47L 11/4013; A47L 11/4027; A47L 11/4044; A47L 2201/00
See application file for complete search history.

(56) References Cited

U.S. PATENT DOCUMENTS 1,938,068 A * 12/1933 Deutscher ..... A47L 11/292 15/384
3,938,212 A * 2/1976 Krier ..... A47L 11/4016 15/349

(Continued)

FOREIGN PATENT DOCUMENTS

DE 202016105296 U1 10/2016
EP 3284383 * 2/2018

(Continued)

*Primary Examiner* — David Redding
(74) *Attorney, Agent, or Firm* — Warner Norcross + Judd LLP

(57) ABSTRACT

The present disclosure provides a surface cleaning apparatus that mechanically removes liquid and debris from a brushroll and stores the mechanically-removed liquid and debris onboard the apparatus in a first collection area. The surface cleaning apparatus also collects further liquid and debris from the brushroll by a source of suction including a vacuum motor or a pump and stores the collected liquid and debris onboard the apparatus in a second collection area.

20 Claims, 15 Drawing Sheets

(51) Int. Cl.

| | |
|---|---|
| ***A47L 11/24*** | (2006.01) |
| ***A47L 11/40*** | (2006.01) |
| ***A47L 9/28*** | (2006.01) |

(56) References Cited

U.S. PATENT DOCUMENTS

| | | | | |
|---|---|---|---|---|
| 10,039,431 | B1 | 8/2018 | Li et al. | |
| 2017/0049288 | A1* | 2/2017 | Knutson | A47L 11/4036 |
| 2019/0082909 | A1 | 3/2019 | Conrad | |
| 2019/0246859 | A1 | 8/2019 | Li | |

FOREIGN PATENT DOCUMENTS

| | | | |
|---|---|---|---|
| EP | 3345526 | A1 | 7/2018 |
| EP | 3453301 | * | 3/2019 |

* cited by examiner

SURFACE CLEANING APPARATUS WITH TWO-STAGE COLLECTION

CROSS-REFERENCE TO RELATED APPLICATION(S)

This application claims the benefit of U.S. Provisional Patent Application No. 62/825,079, filed Mar. 28, 2019, which is incorporated herein by reference in its entirety.

BACKGROUND

Several different types of apparatus are known for cleaning a surface, such as a floor. One category of cleaning apparatus includes a recovery system that extracts liquid and debris (which may include dirt, dust, soil, hair, stains, and other debris) from the surface, and often have a delivery system that delivers cleaning fluid to a surface to be cleaned. Such cleaning apparatus can be configured as upright cleaners, portable or handheld cleaners, unattended or spot cleaners, or autonomous cleaners, i.e. wet cleaning robots.

The recovery system typically includes a recovery tank, a nozzle adjacent the surface to be cleaned and in fluid communication with the recovery tank through a working air conduit, and a source of suction in fluid communication with the working air conduit to draw liquid and debris from the surface to be cleaned and through the nozzle and the working air conduit to the recovery tank. The delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. Often, an agitator such as a brushroll is provided for agitating the surface to be cleaned.

Recovering liquid and debris by suction requires a powerful vacuum motor. Electrical power can be provided by a source of mains electricity or by a battery pack. Cordless or battery-powered cleaning apparatus are generally considered a convenience by many consumers, but often require providing less power to cleaning, and can perform less well overall than their corded counterparts, or else have short runtimes. For autonomous cleaners or cleaning robots that use battery-power for autonomous movement, the power dedicated to cleaning is even more drastically reduced, and do not perform well.

BRIEF SUMMARY

A surface cleaning apparatus is provided herein that collects debris in two stages. In a first stage, the apparatus mechanically collects liquid and solid debris prior to a second stage in which further liquid and/or debris is collected by a source of suction including a vacuum motor or a pump. The two-stage collection can reduce the power requirements for the suction source, which can increase the battery life or runtime of the apparatus without reducing cleaning performance. This can have the added benefit of lowering the cost of the apparatus.

According to one embodiment of the invention, a surface cleaning apparatus is provided with a first collection stage or mechanical collection system for mechanically removing liquid and debris from a brushroll and storing the liquid and debris onboard the apparatus in a first collection area, and a second collection stage or suction collection system for suctioning liquid and debris from a brushroll and storing the liquid and debris onboard the apparatus in a second collection area.

The mechanical collection system can include an inlet opening, a brushroll mounted for rotation in the inlet opening for sweeping, agitating, and/or mopping the surface to be cleaned, and a scraper configured to interface with a portion of the brushroll to scrape liquid and debris off the brushroll.

In one embodiment, the first collection area comprises a collection tray for receiving the liquid and debris mechanically scraped off the brushroll by the scraper. The collection tray can be reusable or disposable.

The suction collection system can include a suction nozzle in close proximity to the brushroll, a suction source in fluid communication with the suction nozzle for generating a working air stream, and a recovery tank for collecting liquid and debris from the working airstream for later disposal. The suction source can comprise a vacuum motor in fluid communication with an outlet of the recovery tank. An inlet of the recovery tank can be in fluid communication with the suction nozzle.

Alternatively, the suction collection system can include a pump in fluid communication with the first collection area for pumping dirty liquid into the second collection area. The first collection area comprises a collection tray for receiving the liquid and debris mechanically scraped off the brushroll by the scraper. The collection tray can include a series of holes to act as a strainer to separate dirty liquid from debris.

In one embodiment, the surface cleaning apparatus is preferably battery-powered. A battery pack is connected to the vacuum motor, and optionally to other electrical components of the apparatus. Optionally, the apparatus can have a charging port or charging contacts that can be used to charge the battery.

The surface cleaning apparatus can include a fluid delivery system for delivering the cleaning fluid to the brushroll. The fluid delivery system can include one or more fluid supply tanks for storing a supply of cleaning fluid and a fluid distributor for applying the cleaning fluid to the brushroll.

In certain embodiments, the brushroll is a hybrid brushroll that includes multiple agitation materials to optimize cleaning performance for different cleaning modes, including dry and wet cleaning.

According to another embodiment of the invention, the mechanical collection stage can comprise an agitator rotatably driven about an rotational axis, a scraper interfacing with a first portion of the agitator, and a first collection area configured to collect debris and liquid mechanically propelled into the first collection area by the agitator and mechanically scraped off the agitator by the scraper, and the suction collection stage can comprise a suction nozzle proximate the agitator and a suction source in fluid communication with the suction nozzle to recover debris and liquid on the agitator in a second collection area. The suction nozzle can confront a second portion of the agitator, the second portion of the agitator being disposed past the first portion of the agitator in a direction of rotation of the agitator about the rotational axis.

According to yet another embodiment of the invention, the mechanical collection stage can comprise an agitator rotatably driven about an rotational axis and a first collection area configured to collect debris and liquid from the agitator, and the suction collection stage can comprise a pump in fluid communication with the first collection area to pump dirty liquid into a second collection area.

In these and other embodiments of the invention, the surface cleaning apparatus comprises an autonomous or robotic surface cleaning apparatus. The components of the various functional systems of the surface cleaning apparatus, including the collection systems and an autonomous drive system, can be mounted in an autonomously moveable housing. In certain embodiments, the robot is a multi-surface robot that can be used to clean hard floor surfaces such as tile and hardwood and soft floor surfaces such as carpet, by performing both dry and wet cleaning.

According to another embodiment of the invention, the surface cleaning apparatus comprises an upright body pivotally mounted to a base that is adapted to move along a surface to be cleaned. The components of the mechanical and suction collection systems can be provided on the upright body, the base, or a combination thereof.

According to yet another embodiment of the invention, the surface cleaning apparatus is a multi-surface wet vacuum cleaner that can be used to clean hard floor surfaces such as tile and hardwood and soft floor surfaces such as carpet. In yet other embodiments, the surface cleaning apparatus is an upright extraction cleaner, a portable or handheld extraction cleaner, or an unattended extraction cleaner or spot cleaner.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF EMBODIMENTS OF THE INVENTION

The invention generally relates to a surface cleaning apparatus having a first collection stage or mechanical collection system for mechanically removing liquid and debris from a brushroll and storing the liquid and debris onboard the apparatus in a first collection area, and a second collection stage or suction collection system for suctioning liquid and debris from a brushroll and storing the liquid and debris onboard the apparatus in a second collection area.

The functional systems of the surface cleaning apparatus can be arranged into any desired configuration, such as an autonomous or robotic device that mounts and/or carries the components of the various functional systems of the apparatus in an autonomously moveable unit. Other optional configurations include an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted as a battery-powered apparatus, including an on-board battery for cordless operation. Any of the aforementioned cleaners can be adapted as multi-surface cleaning apparatus that can be used to clean hard floor surfaces such as tile and hardwood and soft floor surfaces such as carpet, and can perform both dry and wet cleaning.

Aspects of the disclosure may also be incorporated into a steam apparatus, such as surface cleaning apparatus with steam delivery. Aspects of the disclosure may also be incorporated into an apparatus with only recovery capabilities, such as surface cleaning apparatus without fluid delivery.

The term "debris" includes dirt, dust, soil, hair, stains, and other debris, unless otherwise noted. The term "cleaning fluid" includes liquids such as water or a cleaning solution, steam or vapor, unless otherwise noted.

Figure 1:
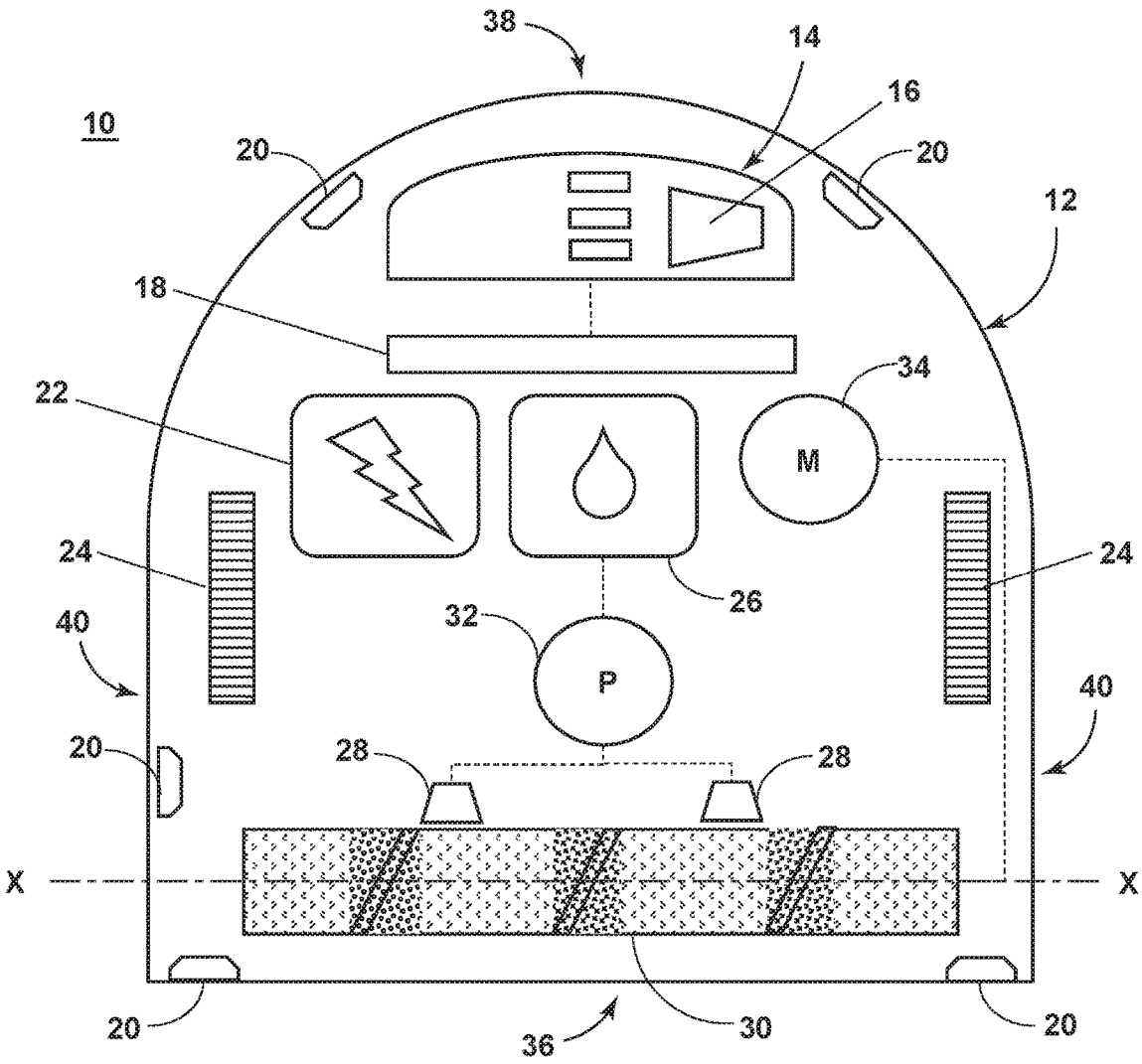
FIG. 1 is a schematic view of a surface cleaning apparatus in the form of an autonomous surface cleaning apparatus or wet cleaning robot according to a first embodiment of the invention.

FIG. 1 is a schematic view of a surface cleaning apparatus according to one aspect of the present disclosure, shown as an autonomous surface cleaning apparatus or wet cleaning robot, and generally designated 10. As discussed in further detail below, the robot 10 is provided with various features and improvements, which are described in further detail below. As illustrated herein, the robot 10 mounts and/or carries the components of various functional systems of a deep cleaner in an autonomously moveable unit or housing 12, including components of a collection system for removing liquid and debris from the surface to be cleaned and storing the liquid and debris on-board the housing 12, a fluid supply system, and a drive system for autonomously moving the robot 10 over the surface to be cleaned.

The robot 10 can include at least one user interface 14 through which a user can interact with the robot 10. The interface 14 can enable operation and control of the robot 10 by the user, and can also provide feedback information from the robot 10 to the user. The user interface 14 can be electrically coupled with electrical components, including, but not limited to, circuitry electrically connected to various components of the fluid delivery and collection systems of the robot 10. The user interface 14 can have one or more input controls, such as but not limited to buttons, triggers, toggles, keys, switches, touch screens, or the like, operably connected to systems in the robot 10 to affect and control its operation. In one example, a power button 16 controls the supply of power to one or more electrical components of the robot 10. The user interface 14 communicate visually and/or audibly. Additionally or alternatively, a user interface for the robot 10 can be provided as an application executed on a smartphone, tablet computer or the like for controlling one or more functions of the robot 10.

The robot 10 can further include a controller 18 operably coupled with the various function systems of the robot 10 for controlling its operation. The controller 18 can be a microcontroller unit (MCU) that contains at least one central processing unit (CPU). The controller 18 can be operably coupled with the user interface 14 for receiving inputs from a user and for providing one or more indicia about the status of the robot 10 to the user, and can further be operably coupled with at least one sensor 20 for receiving input about the environment and can use the sensor input to control the operation of the robot 10. Some non-limiting examples of sensors 20 include distance sensors for determining the distance of the robot 10 relative to obstacles, cliff sensors that provide distance feedback so that the robot 10 can avoid excessive drops such as stairwells or ledges, bump sensors for determining front or side impacts to the robot 10, wall following sensors that provide distance feedback so that the robot 10 can follow near a wall without contacting the wall, accelerometers to sense linear, rotational and magnetic field acceleration, lift-up sensors which detect when the robot 10 is lifted off the surface to be cleaned, such as when the user picks up the robot 10, and floor condition sensors, such as an infrared dirt sensor, a stain sensor, an odor sensor, and/or a wet mess sensor, for detecting a condition of the surface to be cleaned.

The robot 10 can include a power supply on-board the housing 12, which can be a rechargeable battery 22 (e.g. a battery pack or a plurality of battery cells). In one example, the battery 22 can be a lithium ion battery. An appropriate charger can be provided with the robot 10. In one embodiment, the robot 10 can have a charging port used to charge the battery 22. A charging cable (not shown) can be provided for plugging the robot 10 into a household outlet. In an alternative embodiment, the robot 10 can have charging contacts on the housing 12, and a docking station (not shown) can be provided for docking the robot 10 for recharging the battery 22.

The autonomous drive system is configured for autonomously moving the robot 10 over the surface to be cleaned. The robot 10 can be configured to move randomly about a surface while cleaning the floor surface, using input from various sensors to change direction or adjust its course as needed to avoid obstacles, or can include a navigation/mapping system for guiding the movement of the robot 10 over the surface to be cleaned. In one embodiment, the robot 10 includes a navigation and path planning system that is operably coupled with the drive system. The system builds and stores a map of the environment in which the robot 10 is used, and plans paths to methodically clean the available area. An artificial barrier system (not shown) can optionally be provided with the robot 10 for containing the robot 10 within a user-determined boundary.

The drive system can include drive wheels 24 for driving the robot 10 across a surface to be cleaned. The drive wheels 24 can be operated by a common drive motor or individual drive motors (not shown) coupled with the drive wheels 24 by a transmission, which may include a gear train assembly or another suitable transmission. The drive system can receive inputs from the controller 18 for driving the robot 10 across a floor, based on inputs from the navigation/mapping system. The drive wheels 24 can be driven in a forward or reverse direction in order to move the housing 12 forwardly or rearwardly, and can be operated simultaneously or individually in order to turn the housing 12 in a desired direction. The controller 18 can receive input from the navigation/mapping system for directing the drive system to move the robot 10 over the surface to be cleaned. The navigation/mapping system can include a memory that stores maps for navigation and inputs from various sensors, which is used to guide the movement of the robot 10.

The fluid delivery system can include a supply tank 26 for storing a supply of cleaning fluid and at least one fluid distributor 28 in fluid communication with the supply tank 26. The cleaning fluid can be a liquid such as water or a cleaning solution specifically formulated for hard surface cleaning.

The supply tank 26 can be mounted to the housing 12 in any configuration. In the present embodiment, the supply tank 26 can be removable from the housing 12 for filling or refilling. In other embodiments, the supply tank 26 can be disposable and replaceable.

The fluid distributor 28 can be one or more spray nozzles or spray tips provided on the housing 12 of the robot 10. Alternatively, the fluid distributor 28 can be a manifold having multiple outlets.

The fluid distributor 28 can be positioned to dispense cleaning fluid onto the surface to be cleaned, either directly onto the surface to be cleaned, such as by having an outlet of the fluid distributor 28 positioned in opposition to the surface, or indirectly onto the surface to be cleaned, such as by having an outlet of the fluid distributor 28 positioned to dispense onto an agitator such as a brushroll 30. In the illustrated embodiment, the fluid distributor 28 is positioned to dispense cleaning fluid onto the brushroll 30. Alternatively, the fluid distributor 28 can be configured for spraying directly onto a floor over which the housing 12 autonomously moves, and can in particular dispense cleaning fluid beneath the housing 12 or can dispense cleaning fluid outwardly from the housing 12 so that the user can see exactly where cleaning fluid is being dispensed. For example, the fluid distributor 28 can dispense cleaning fluid forwardly, rearwardly, laterally, or anywhere outward from the housing 12 of the robot 10. As yet another alternative, multiple fluid distributors can be provided to dispense cleaning fluid onto the brushroll 30 and directly onto a floor.

A fluid delivery pump 32 can be provided in the fluid pathway between the supply tank 26 and the fluid distributor 28 to control the flow of fluid to the fluid distributor 28. Various combinations of optional components can be incorporated into the fluid delivery system as is commonly known in the art, such as a heater for heating the cleaning fluid before it is applied to the surface, or one more fluid control and mixing valves.

A brush motor 34 can be provided within the housing 12 to drive the brushroll 30. A drive transmission (not shown), for example including a belt, operably connects a motor shaft of the motor 34 with the brushroll 30 for transmitting rotational motion of the motor shaft to the brushroll 30. Alternatively, the brushroll 30 can be driven mechanically by the autonomous movement of the robot 10.

The brushroll 30 can be mounted at the front of the robot 10, whereas brushrolls on most autonomous surface cleaners are mounted near middle of the unit, and hidden under an opaque plastic housing. As used herein for the robot 10, "front" or "forward" and variations thereof are defined relative to the direction of forward travel of the autonomous robot 10, unless otherwise specified. The housing 12 of the illustrated robot 10 can be configured to accommodate the brushroll 30 in the forward location, such as by having an overall "D-shape" when viewed from above as schematically shown in FIG. 1, with the housing 12 having a straight front side 36 and a rounded rear side 38. The housing 12 can further include lateral sides 40 that generally extend between the straight front side 36 and the rounded rear side 38, and can be straight, rounded, or otherwise contoured. Alternatively, the robot 10 can be configured such that the direction of forward travel renders the rounded side 38 is the front side of the robot 10 and the brushroll 30 is mounted at the rear of the robot 10.

Figure 2:
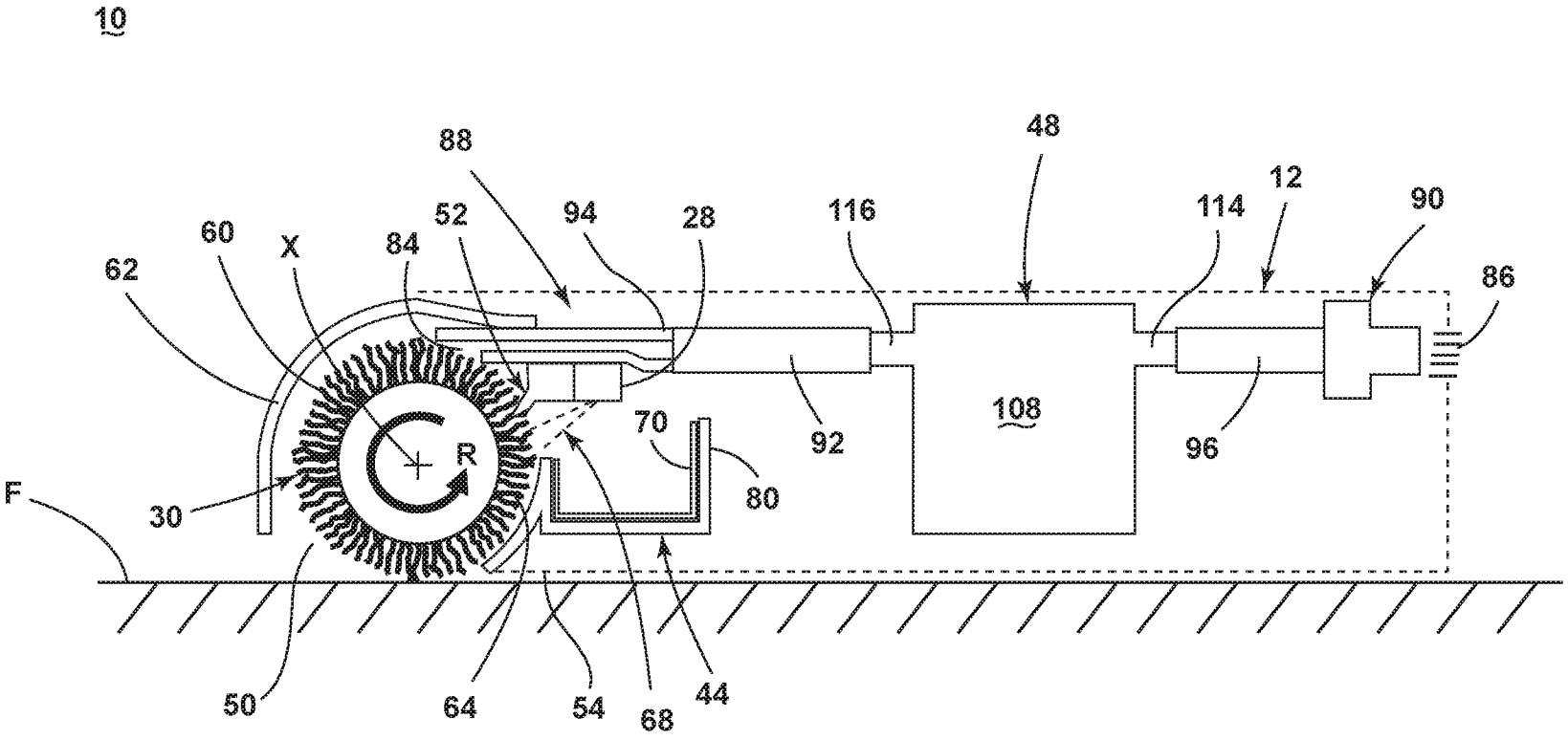
FIG. 2 is a sectional schematic view of the robot from FIG. 1, showing a two-stage collection system of the robot.

FIG. 2 is a sectional schematic view of the robot 10 from FIG. 1, showing various components of the collection system of the robot 10. The collection system of the robot 10 shown includes two stages, including a first collection stage or mechanical collection system for mechanically removing liquid and debris from the brushroll 30 and storing the liquid and debris onboard the housing 12 in a first collection area 44, and a second collection stage or suction collection system for suctioning liquid and debris from the brushroll 30 and storing the liquid and debris onboard the housing 12 in a second collection area 48.

The robot 10 can include an inlet opening 50. The inlet opening 50 can be provided on a lower side 54 of the housing 12 adapted to be adjacent the surface to be cleaned or floor surface F as the housing 12 moves autonomously across a floor. The brushroll 30 can be provided adjacent to the inlet opening 50 and configured to contact the floor surface F through the inlet opening 50 for sweeping, agitating, and/or mopping the floor surface F, as described in more detail below.

The mechanical collection system can include the brushroll 30 mounted for rotation in the inlet opening 50 for sweeping, agitating, and/or mopping the floor surface F, a scraper 52 configured to interface with a portion of the brushroll 30 to scrape liquid and debris off the brushroll 30, as described in further detail below, and the first collection area 44, which receives the liquid and debris mechanically scraped off the brushroll 30 by the scraper 52. In addition, in some embodiments of the robot 10, some debris and/or liquid swept up by the rotating brushroll 30 can be mechanically propelled directly into the first collection area 44, i.e. without being scraped off by the scraper 52.

As discussed above, the fluid distributor 28 is positioned to dispense cleaning fluid onto the brushroll 30. In the illustrated embodiment, the fluid distributor 28 can comprise at least one spray nozzle or spray tip, which is angled or otherwise formed to spray at an outward and downward angle onto the brushroll 30. The brushroll 30 is mounted for rotational movement in a direction R about a central rotational axis X, which can be a substantially horizontal axis or an axis generally parallel to the surface over which the housing 12 moves.

Figure 3:
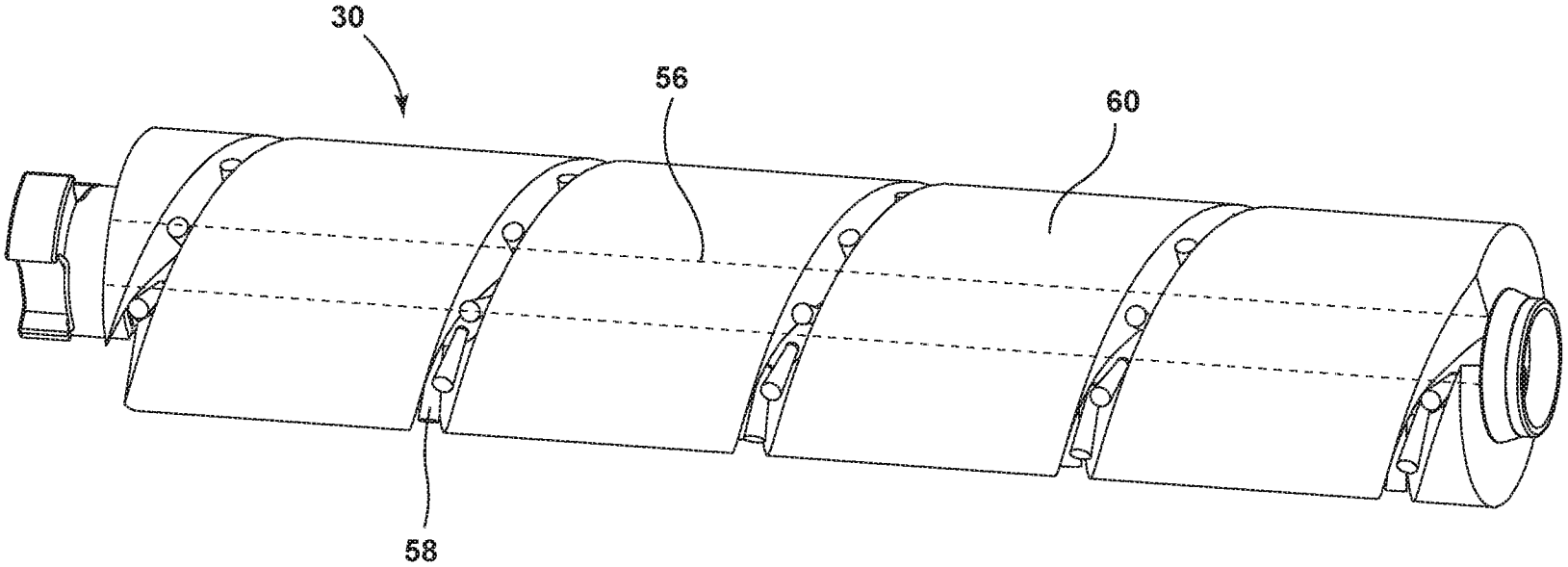
FIG. 3 is a perspective view of a brushroll for the robot from FIG. 1.

One embodiment of the brushroll 30 for the robot 10 is shown in FIG. 3. In the present example, brushroll 30 can be a hybrid brushroll suitable for dry or wet cleaning. In one embodiment, the brushroll 30 comprises a dowel 56, a plurality of bristles 58 extending from the dowel 56, and microfiber material 60 provided on the dowel 56 and arranged between the bristles 58. One example of a suitable hybrid brushroll is disclosed in U.S. Pat. No. 10,092,155, issued Oct. 9, 2018, which is incorporated herein by reference in its entirety. The bristles 58 can be arranged in a plurality of tufts or in a unitary strip. Dowel 56 can be constructed of a polymeric material such as acrylonitrile butadiene styrene (ABS), polypropylene or styrene, or any other suitable material such as plastic, wood, or metal. Bristles 58 can be tufted or unitary bristle strips and constructed of nylon, or any other suitable synthetic or natural fiber. The microfiber material 60 can be constructed of polyester, polyamides, or a conjugation of materials including polypropylene or any other suitable material known in the art from which to construct microfiber.

Other embodiments of the brushroll 30 are possible. For example, the brushroll 30 can comprise tufted bristles as the only agitation medium. Alternatively, the brushroll 30 can comprise microfiber or another agitation medium made of a soft and compressible material as the only agitation medium. In still other embodiments, the brushroll 30 can comprise nylon fiber, foam, elastomeric blades, paddles, or any combination thereof. Additionally, while a horizontally-rotating brushroll 30 is shown herein, in some embodiments, dual horizontally-rotating brushrolls, one or more vertically-rotating brushrolls can be provided on the robot 10.

Returning to FIG. 2, the robot 10 can include a brush chamber 62 in which the brushroll 30 is mounted. The scraper 52 can be mounted to or otherwise provided on the housing 12, and can extend into the brush chamber 62 to interface with a portion 64 of the brushroll 30. More specifically, the scraper 52 is configured to engage with a first trailing portion 64 of the brushroll 30, as defined by the direction of rotation R of the brushroll 30 about brush rotational axis X, and as the brushroll 30 rotates, can scrape liquid and debris off the brushroll 30.

In one embodiment, the scraper 52 can be an elongated wiper or blade that generally spans the transverse length of the brushroll 30. The scraper 52 can be a thin or narrow edge, such as a blade or wiper. Optionally, the scraper 52 can be angled forwardly to encourage the scraper 52 to dig into the brushroll 30 as it rotates past the scraper 52. Alternatively, the scraper 52 can be disposed generally orthogonal to the surface to be cleaned, or vertically. The scraper 52 can comprise smooth front and rear surfaces as shown, or optionally comprise ridges or nubs on either side.

Figure 4:
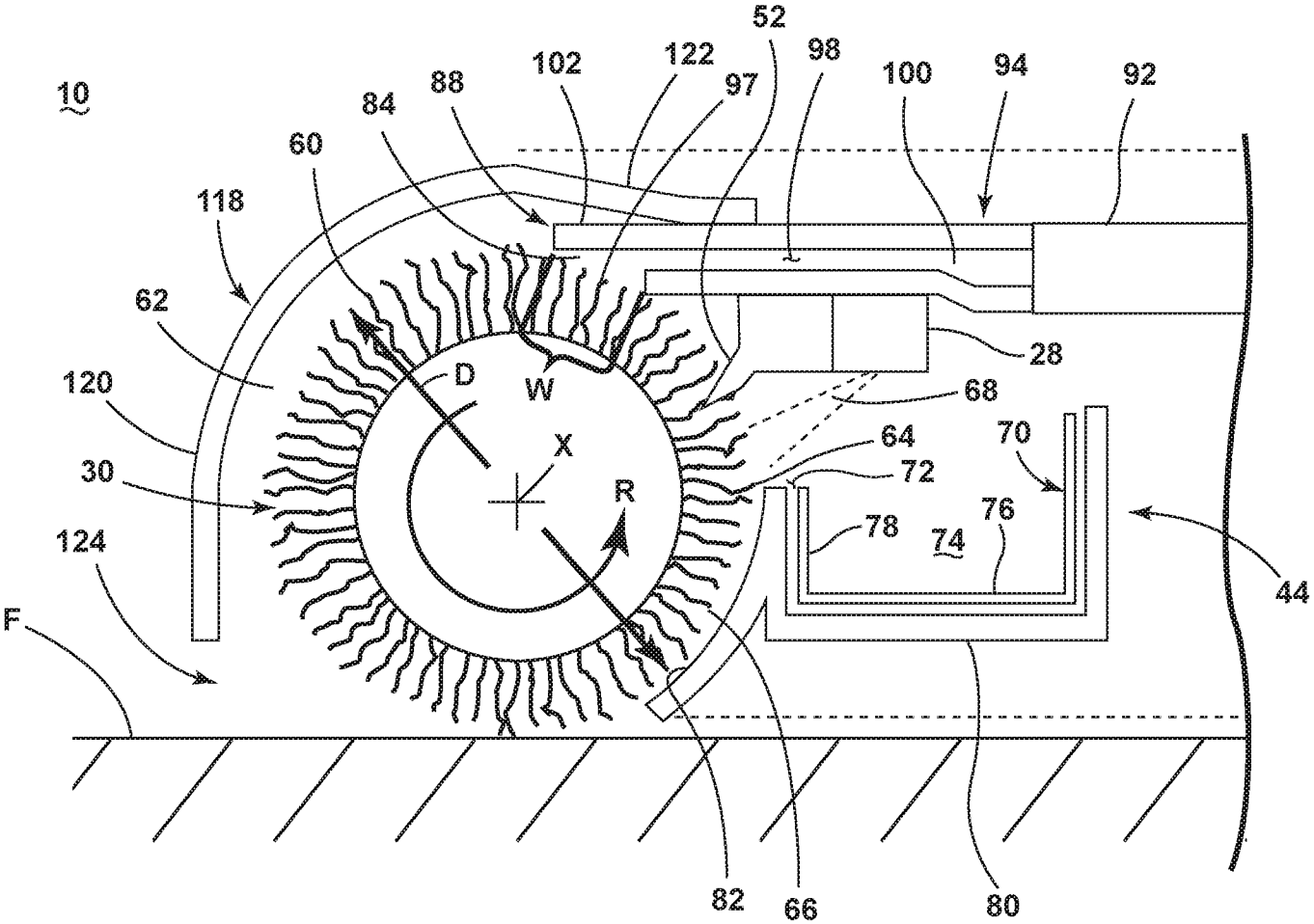
FIG. 4 is a view similar to FIG. 2, showing a close-up view of a brushroll, brush chamber, and first collection area.

FIG. 4 shows a close-up view of the brushroll 30 and brush chamber 62. The scraper 52 can be provided at a rear side or trailing side 66 of the brush chamber 62, and can be configured to engage with the trailing portion 64 of the brushroll 30, as defined by the direction of rotation R of the brushroll 30 about brush rotational axis X. As the brushroll 30 rotates, the scraper 52 compresses the trailing portion 64 of the brushroll 30 and scrapes dirty liquid and debris off the brushroll 30. The scraper 52 can also help redistribute the liquid evenly along the length of the brushroll 30, which can help to reduce streaking on the surface to be cleaned.

Optionally, the scraper 52 can be rigid, i.e. stiff and non-flexible, so the scraper 52 does not yield or flex by engagement with the brushroll 30. In one example, the scraper 52 can be formed of rigid thermoplastic material, such as poly(methyl methacrylate) (PMMA), polycarbonate, or acrylonitrile butadiene styrene (ABS). Alternatively, the scraper 52 can be pliant, i.e. flexible or resilient, in order to deflect according to the contour of the brushroll 30.

In the illustrated embodiment of the robot 10, the rigid scraper 52 interfaces with a hybrid brushroll 30, as shown in FIG. 3, which includes multiple agitation materials to optimize cleaning performance during different cleaning modes, including dry and wet cleaning. The mechanical debris removal performed by the scraper 52 can depend on the agitation material of the brushroll 30. In the base of the hybrid brushroll 30 shown in FIG. 3, the scraper 52 compresses the microfiber material 60 at the trailing portion 64 of the brushroll 30 and squeezes liquid out from the microfiber material 60. The scraper 52 can also deflect the bristles 58 as they rotate past the scraper 52 to flick debris and liquid off the bristles 58 and into the first collection area 44.

The scraper 52 and the fluid distributor 28 can be positioned relative to each other such that a spray of cleaning fluid from the fluid distributor 28 strikes the brushroll 30 just prior to where the scraper 52 interfaces with the brushroll 30 at the first portion 64. In one example, the fluid distributor 28 can be positioned to direct a spray 68 of cleaning fluid below the scraper 52 to wet a portion of the brushroll 30 prior to rotation of that portion of the brushroll 30 past the scraper 52. In particular, the spray 68 can wet the trailing portion 64 of the brushroll 30 just before it rotates past the scraper 52.

The first collection area 44 can be any type of collection area, cup, tray, bin, or tank suitable for the purposes described herein, including the collection of debris and liquid. In the illustrated embodiment, the first collection area 44 comprises a collection tray 70 that has a generally open top defining an entrance opening 72 into a collection space or chamber 74 of the tray 70, and which is in fluid communication with, i.e. open to, the brush chamber 62. Debris and liquid that is scraped off the brushroll 30 by the scraper 52 can fall through the entrance opening 72 into the collection tray 70. Additionally, in some embodiments, liquid and debris can spin off the rotating brushroll 30 and fly backwards into the collection tray 70.

In the illustrated embodiment, the collection tray 70 is rectilinear in shape, including a closed bottom wall 76 and a peripheral side wall 78 extending upwardly from the bottom wall 76. The peripheral side wall 78 can define the open top or entrance opening 72 into the collection chamber 74. The collection tray 70 can further be elongated transversely, and can, for example be generally coextensive with the transverse length of the brushroll 30 and/or scraper 52.

The collection tray 70 can be removable from the housing 12 for emptying. The housing 12 can include a collection tray receiver 80 for receiving the collection tray 70. The collection tray 70 can slide into or otherwise be seated in the collection tray receiver 80 to install the collection tray 70 on the housing 12. In one embodiment, the collection tray 70 can be removed through one of the lateral sides 40 (FIG. 1) of the housing 12 for emptying. In other embodiments, the collection tray 70 can be removed from the bottom of the housing 12 or from the top of the housing 12.

Optionally, the robot 10 can include a collection tray latch (not shown) for securing the collection tray 70 to the housing 12. The collection tray latch can be configured to releasably lock the collection tray 70 on the housing 12 so that that a user must actuate the latch before removing the collection tray 70 from the housing 12. Alternatively, collection tray latch can be configured to releasably latch or retain, but not lock, the collection tray 70 on the housing 12, such that a user can conveniently apply sufficient force to the collection tray 70 itself to pull the collection tray 70 out of the collection tray receiver 80.

As disclosed above, the brushroll 30 can be provided adjacent to the inlet opening 50 for sweeping, agitating, and/or mopping the floor surface F. A ramp 82 can be provided at a rear portion of the brush chamber 62 to help move debris and liquid upward to the entrance opening 72 and into the collection chamber 74. Optionally, the ramp 82 itself can define part of the brush chamber 62, particularly a rear part of the brush chamber 62. The ramp 82 can extend upwardly as an inclined surface from the rear side of the inlet opening 50 to the entrance opening 72. The scraper 52 and the suction nozzle 88 can be disposed generally above the ramp 82, such that a portion of the brushroll 30 will ride up the ramp 82 prior to reaching the scraper 52 and the suction nozzle 88.

Referring to FIG. 2, the suction collection system can include an extraction path through the housing 12 having a dirty inlet 84 and a clean air outlet 86, an extraction or suction nozzle 88 which is positioned to confront the brushroll 30, a suction source or vacuum motor 90 in fluid communication with the suction nozzle 88 for generating a working air stream, and the second collection area 48 which receives liquid and debris suctioned off the brushroll 30 by the suction nozzle 88.

The vacuum motor 90 is in fluid communication with the suction nozzle 88 and the second collection area 48 for generating a working air stream through the extraction path. The vacuum motor 90 can be carried by the housing 12, fluidly upstream of the air outlet 86, and can define a portion of the extraction path. Optionally, the suction collection system can be provided with one or more additional filters upstream or downstream of the vacuum motor 90, such as a pre-motor filter and/or a post-motor filter (not shown).

The suction nozzle 88 removes liquid and debris from the brushroll 30, rather than the floor surface F, and defines the dirty inlet 84, also referred to herein as suction nozzle inlet 84. The suction nozzle 88 can be any type of suction tool suitable for the purposes described herein, including the collection of debris and liquid from the brushroll 30. In the illustrated embodiment, the dirty inlet or suction nozzle inlet 84 comprises an elongated slot or opening facing the brushroll 30. The nozzle inlet 84 generally spans the brushroll 30 along its transverse length to remove liquid and debris across substantially the entire transverse length of the brushroll 30. A conduit, duct, tubing or hose 92 can fluidly couple an outlet 94 of the suction nozzle 88 with the second collection area 48. The suction collection system can be provided with various other conduits, ducts, tubing and/or hoses fluidly coupling components of the suction collection system together, including a second conduit, duct, tubing or hose 96 fluidly coupling an air outlet opening of the second collection area 48 with the vacuum motor 90.

Referring to FIG. 4, the suction nozzle 88 is configured to remove liquid and debris from the brushroll 30. In many conventional vacuum cleaner designs, the suction nozzle is large enough to accommodate the brushroll, and the suction nozzle inlet is adjacent the floor surface to remove liquid and debris from the floor surface. Here, the suction nozzle 88 is disposed away from the inlet opening 50 and the floor surface F and the suction nozzle 88 is disposed at upper rear quadrant of the brushroll 30 to remove liquid and fine debris from the brushroll 30. The scraper 52 and the suction nozzle 88 can be positioned relative to each other such that the suction nozzle 88 removes liquid and debris from a portion of the brushroll 30 past where the scraper 52 interfaces with the brushroll 30. In particular, the suction nozzle 88 can be disposed to engage the brushroll 30 at a second portion 97 just past the first portion 64 of the brushroll 30, as defined by the direction of rotation R of the brushroll 30 about brush rotational axis X.

In some embodiments of the robot 10, at least a portion of the suction nozzle inlet 84 is in contact with the brushroll 30. For example, the suction nozzle inlet 84 can be in contact with the circumference of the brushroll 30, such that the suction nozzle inlet 84 does not substantially compress the brushroll 30. Alternatively, the suction nozzle inlet can dig into the brushroll 30, such that the suction nozzle inlet 84 compresses the brushroll 30. In either case, the edges of the suction nozzle inlet 84 can engage the brushroll 30 and act like a squeegee to help mechanically force liquid from the brushroll 30. In yet another embodiment, the suction nozzle inlet 84 is spaced from or out of contact with the brushroll 30, but is still capable of suctioning liquid and fine debris from the brushroll 30.

The suction nozzle 88 defines a nozzle passage 98 extending from the suction nozzle inlet 84 to the nozzle outlet 94, and which is formed by at least two spaced nozzle walls, a first nozzle wall 100 and a second nozzle wall 102. In the illustrated embodiment, the first nozzle wall 100 is a lower nozzle wall and the second nozzle wall 102 is an upper nozzle wall, though other orientations are possible. For example, the nozzle walls 100, 102 can comprise front and rear nozzle walls.

A portion of both nozzle walls 100, 102 can be in contact with the brushroll 30. Alternatively, just the first nozzle wall 100 or just the second nozzle wall 102 can be in contact with the brushroll 30. As yet another alternative, both nozzle walls 100, 102 can be out of contact with the brushroll 30.

The suction nozzle inlet 84 can be configured to follow the curvature of the brushroll 30 over an arc of the circumference of the brushroll 30. In the illustrated embodiment, the second or upper nozzle wall 102 projects forwardly of the first or lower wall 100 to closely follow the curvature of the brushroll circumference and more closely engage against the brushroll 30.

As noted above, in many conventional vacuum cleaner designs, the suction nozzle surrounds the brushroll. Here, the suction nozzle inlet 84 is smaller than the brushroll 30, and in particular has a width W that is smaller than a diameter D of the brushroll 30. In the illustrated embodiment, the width W of the suction nozzle inlet 84 can be measured as the shortest distance between the ends of the nozzle walls 100, 102. The diameter D of the brushroll 30 can be measured along a straight line passing through the center of the brushroll 30 and meeting the circumference or outermost surface of the brushroll 30 at each end. The ratio of the nozzle inlet width W to the brushroll diameter D can be, for example, 1:2, 1:5, 1:10, or 1:20.

Like the suction nozzle 88, the scraper 52 is disposed away from the inlet opening 50 and the floor surface F at an upper rear quadrant of the brushroll 30 to scrape liquid and debris from a portion of the rotating brushroll 30 before the suction nozzle suctions additional liquid and debris from that portion of the brushroll 30. In the illustrated embodiment, the scraper 52 is disposed below the nozzle inlet 84, and in particular can extend or depend from the lower nozzle wall 100 of the suction nozzle 88. Other locations for the scraper 52 are also possible.

Starting with a portion of the rotating brushroll 30 in contact with the floor surface F, in operation that portion rotates up the ramp 82, is optionally wetted by the fluid distributor 28, scraped by the scraper 52, and suctioned by the suction nozzle 88 before rotating back into contact with the floor surface F. The scraper 52 tends to remove larger or coarser debris from the brushroll 30, while finer debris is removed by the suction nozzle 88. Accordingly, larger or coarser debris may typically be collected in the first collection area 44, while finer debris may typically be collected in the second collection area 48.

Referring to FIG. 2, the second collection area 48 can be any type of collection area, cup, tray, bin, or tank suitable for the purposes described herein, including the collection of debris and liquid. In the illustrated embodiment, the second collection area 48 comprises a recovery tank 108 for collecting liquid and debris from the working airstream for later disposal. The recovery tank 108 can also define a portion of the extraction path and can comprise an air/liquid separator for separating liquid and entrained debris from the working airstream and a collection chamber in which the separated liquid and debris are collected. One example of a suitable recovery tank having an air/liquid separator and a collection chamber is disclosed in U.S. Pat. No. 10,092,155, incorporated above. The vacuum motor 90 can be in fluid communication with an air outlet 114 of the recovery tank 108, such as via conduit 96 as described above. An inlet 116 of the recovery tank 108 can be in fluid communication with the suction nozzle 88, such as via conduit 92 as described above.

Optionally, the robot 10 can include a recovery tank latch (not shown) for securing the recovery tank 108 to the housing 12. The recovery tank latch can be configured to releasably lock the recovery tank 108 on the housing 12 so that that a user must actuate the latch before removing the recovery tank 108 from the housing 12. Alternatively, recovery tank latch can be configured to releasably latch or retain, but not lock, the recovery tank 108 on the housing 12, such that a user can conveniently apply sufficient force to the recovery tank 108 itself to pull the recovery tank 108 off the housing 12.

Referring to FIGS. 1 and 4, the brushroll 30 and brush chamber 62 can be provided at the front side 36 of the housing 12. In one embodiment, the brush chamber 62 can be at least partially defined by a cover 118 provided on the housing 12 which encloses the brushroll 30 or other agitator, and optionally also encloses the suction nozzle 88, scraper 52, and/or fluid distributor 28. The cover 118 can be at least partially formed from a translucent or transparent material, such that an interior space of the robot 10, such as the brushroll 30, suction nozzle 88, scraper 52, and/or fluid distributor 28 is visible to the user through the cover 118. In yet another embodiment, the first collection area 44, and optionally the second collection area 48, is visible to the user through the cover 118.

In one embodiment, the cover 118 can be removably mounted on the housing 12, and can be releasably secured to the housing 12 by at least one cover latch (not shown). In such an embodiment, at least a portion of the suction nozzle 88, including the nozzle inlet 84, can be carried on or otherwise formed with the cover 118. Optionally, one or both of the scraper 52 and the fluid distributor 28 can be carried on or otherwise formed with the cover 118, and can therefore be removable with the cover 118.

In the illustrated embodiment, the cover 118 includes a curved forward end 120 that can wrap around and in front of the brushroll 30 to define the brush chamber 62 and a rearward end 122 that can extend over the collection tray 70 to cover the open top of the collection tray 70. The cover 118 can define at least the straight front side 36 of the housing 12; more particularly, the curved forward end 120 of the cover 118 can define at least the straight front side 36 of the housing 12.

Optionally, the brushroll 30 can be configured to be removed by the user from the housing 12, such as for cleaning and/or drying the brushroll 30. The brushroll 30 can be removably mounted in the brush chamber 62 by a brushroll latch (not shown). The cover 118 can be removed to expose the brushroll 30, which can then be removed by the user from above the housing 12. Alternatively, the brushroll 30 can be configured for removal without first removing the cover 118, such as by being removable from the bottom side of the housing 12 or through a lateral side of the housing 12.

The forward end 120 of the cover 118 can be spaced from the floor surface F, to allow the lower edge of the cover 118 to move over larger debris on the surface to be cleaned, and prevents the robot 10 from plowing larger debris in front of the housing 12 on forward movement of the robot 10. Larger debris instead moves through the front opening 124 and is swept up by the brushroll 30.

Figure 5:
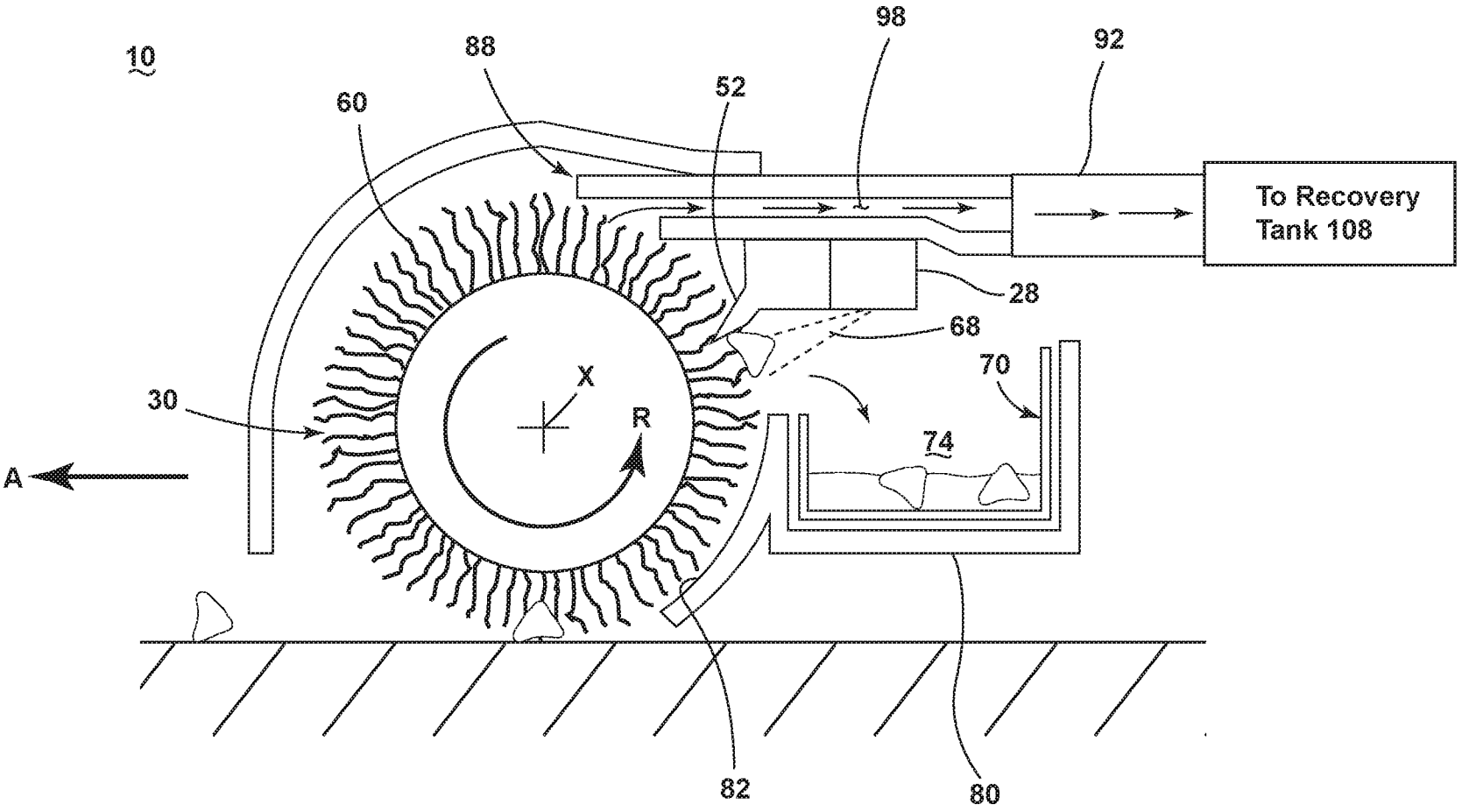
FIG. 5 is a view similar to FIG. 4, showing a wet cleaning or mopping operation of the robot.

During operation, the robot 10 moves autonomously over the floor surface F. Referring to FIG. 5, the robot 10 is depicted as autonomously moving in the direction indicated by arrow A, although other directions are possible. As shown in FIG. 5, in some cleaning operations, the robot 10 can be used to perform wet cleaning or mopping, in which liquid is applied to the brushroll 30 from the distributor 28. In this case, the wetted rotating brushroll 30 can mop the floor surface F, and can collect and move liquid and debris up the ramp 82 and into the collection chamber 74. The scraper 52 mechanically removes additional debris from the brushroll 30, which falls into the collection tray 70. The scraper 52 also squeezes dirty liquid out of the brushroll 30 by mechanically compressing the brushroll 30, and particularly compressing the microfiber material 60. After passing the scraper 52, the suction nozzle 88 removes additional liquid and debris from the brushroll 30, which is collected in the recovery tank 108.

Figure 6:
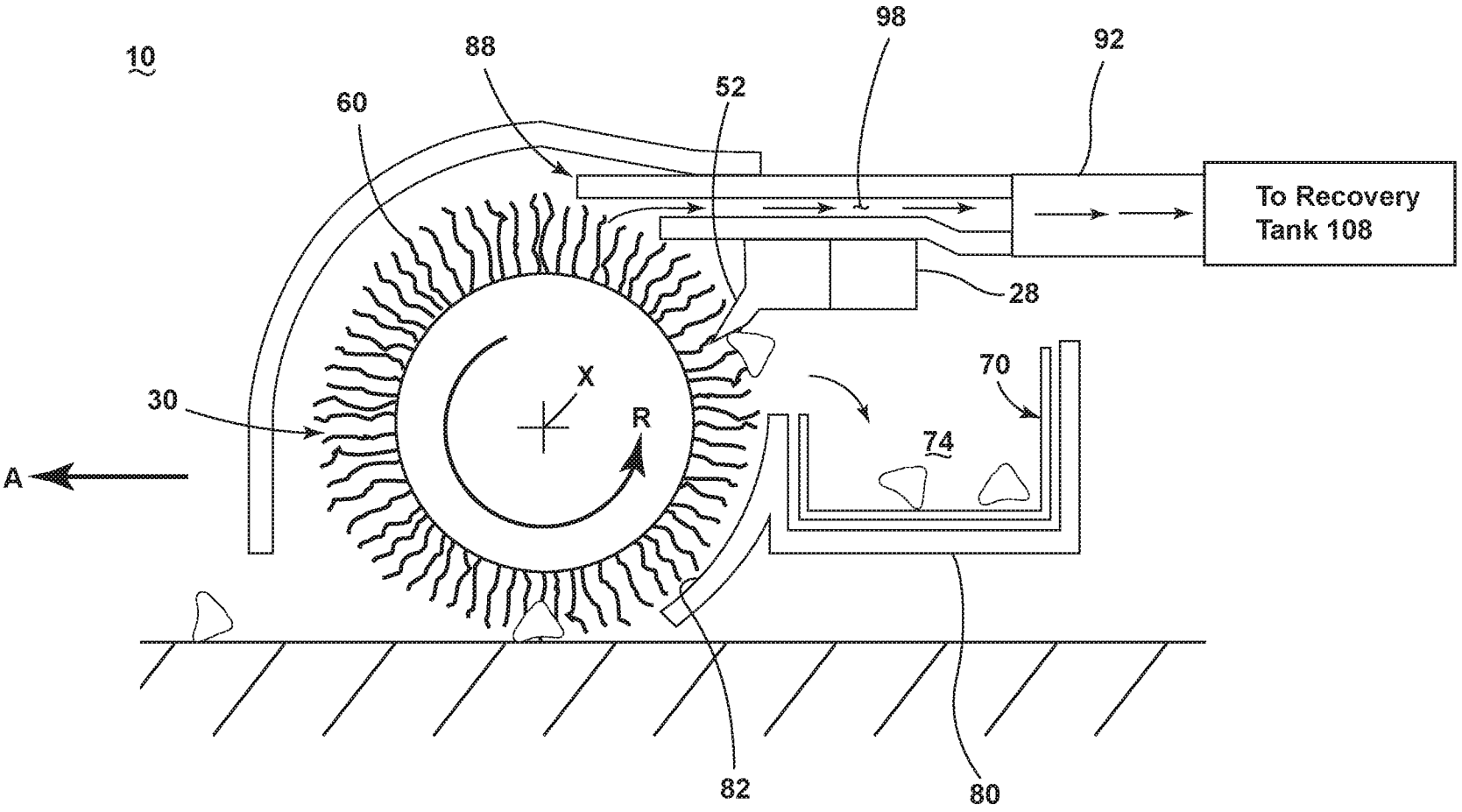
FIG. 6 is a view similar to FIG. 4, showing a dry cleaning or vacuuming operation of the robot.

Referring to FIG. 6, the robot 10 can be used to perform dry cleaning or vacuuming, in which liquid is not applied from the distributor 28 and the floor surface F is otherwise relatively dry. In this case, the rotating brushroll 30 can sweep and/or agitate the floor surface F and can collect and move dry debris up the ramp 82 and into the collection chamber 74. The scraper 52 mechanically removes additional debris from the brushroll 30, which falls into the collection tray 70. After passing the scraper 52, the suction nozzle 88 removes additional debris from the brushroll 30, which is collected in the recovery tank 108.

Figure 7:
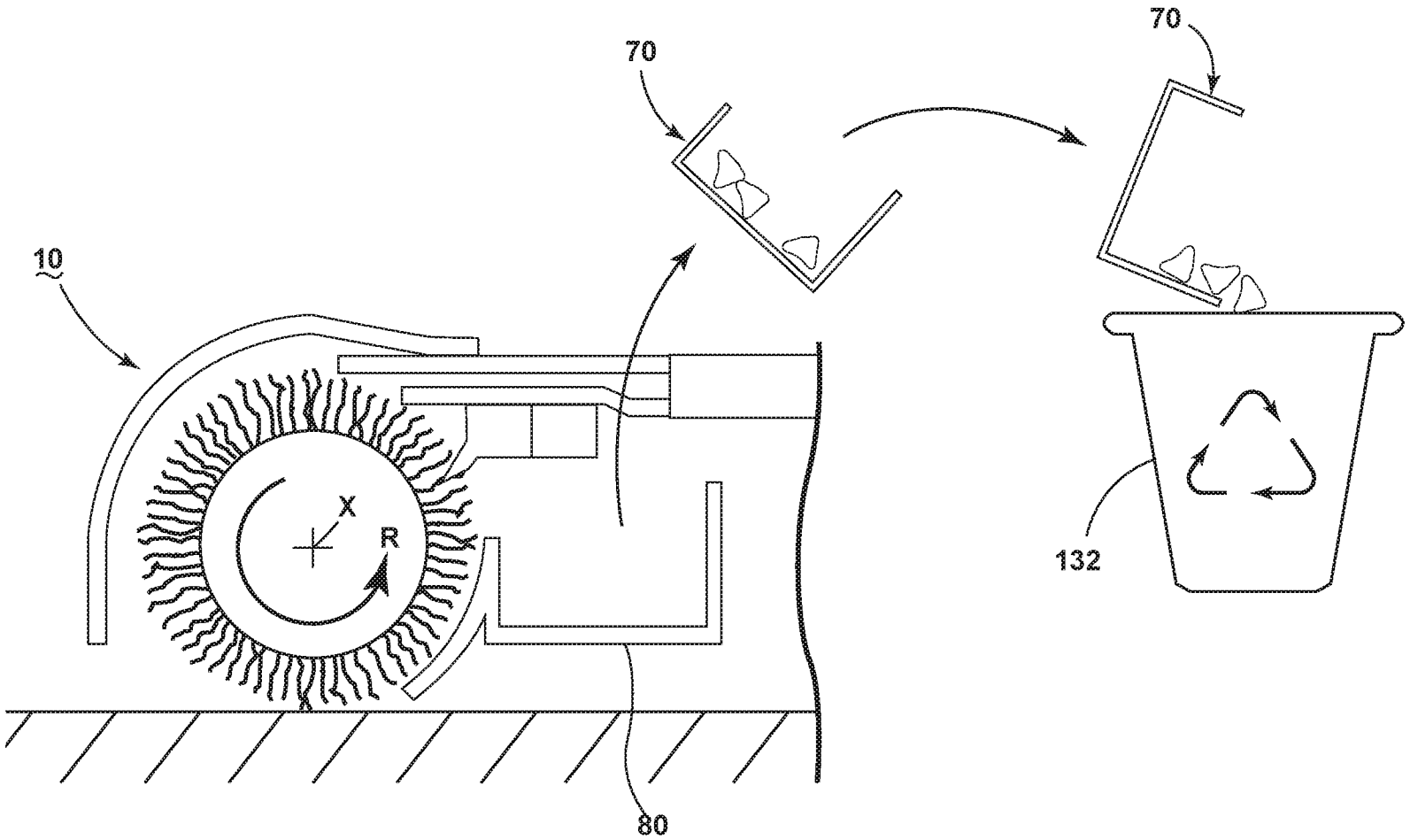
FIG. 7 is a schematic view showing a reusable collection tray removed from the robot for emptying.

Referring to FIG. 7, after a wet or dry cleaning operation, the collection tray 70 can be removed from the tray receiver 80. The debris and/or liquid collected therein can be disposed of in a trashcan, toilet, or other waste receptacle 132. The collection tray 70 can thereafter be reassembled to the robot 10 for further use. While not shown, the recovery tank 108 (FIG. 2) can also be emptied at this time.

Figure 8:
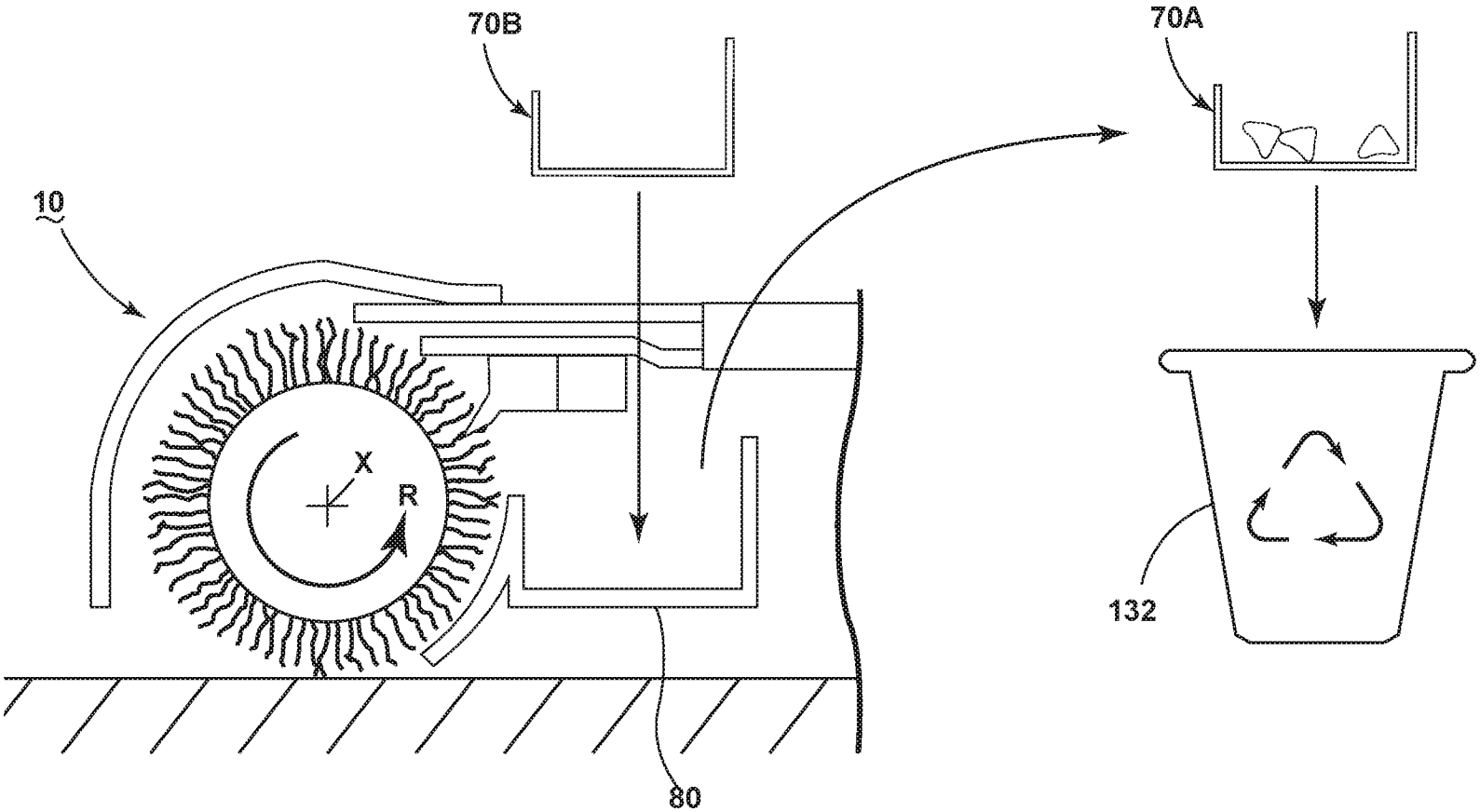
FIG. 8 is a schematic view showing a disposable collection tray removed from the robot for disposal.

Alternatively, with reference to FIG. 8, the robot 10 can have a disposable collection tray 70A, and after a wet or dry cleaning operation, the disposable collection tray 70A can be removed from the tray receiver 80, and the entire tray 70A, including the debris and/or liquid collected therein, can be disposed of in a trash can, toilet, or other waste receptacle 132. This can help simplify the end-of-run maintenance process for a user. A new disposable collection tray 70B can thereafter be provided to the robot 10.

Figure 9:
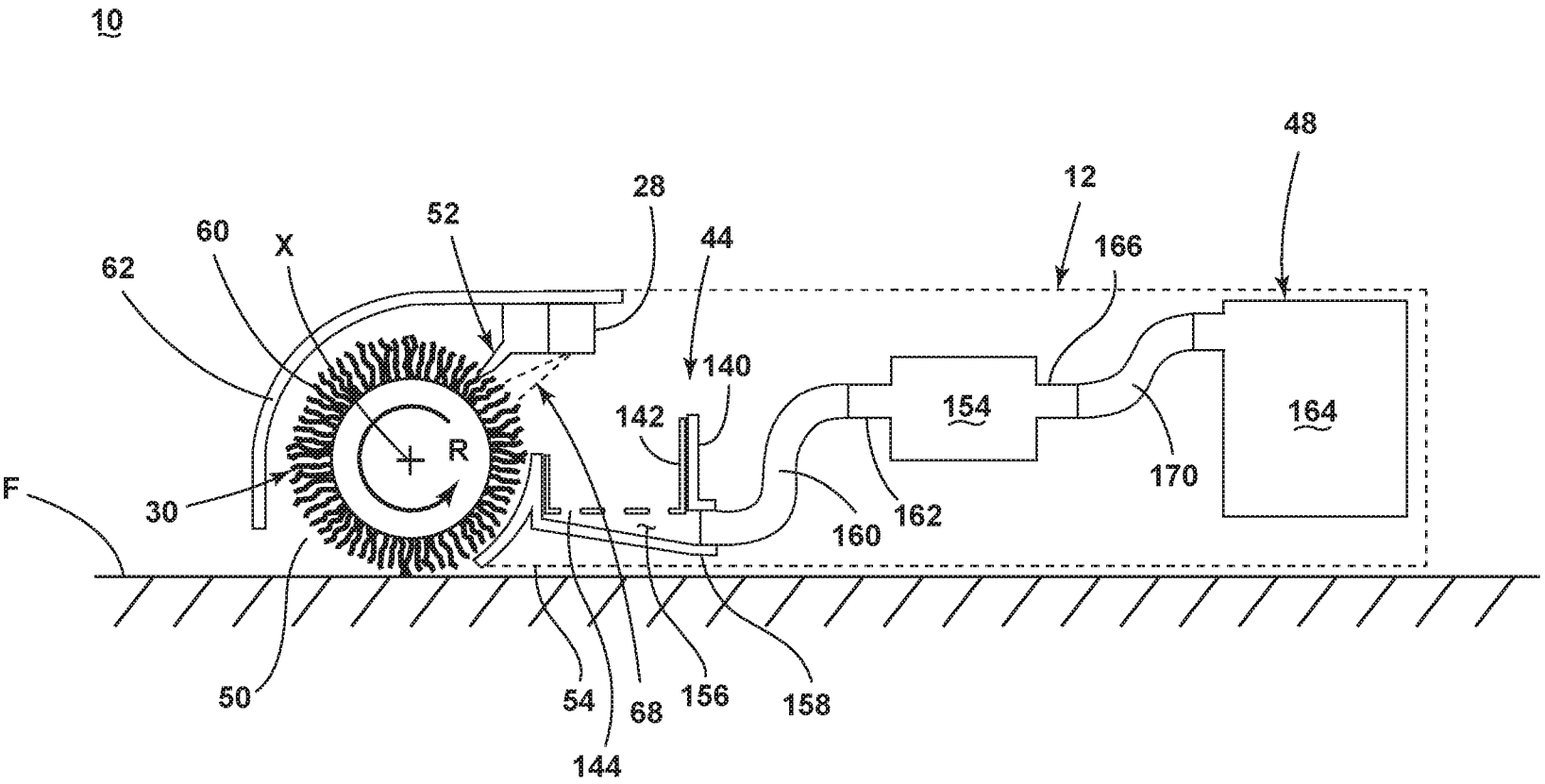
FIG. 9 is a sectional schematic view of a surface cleaning apparatus in the form of an autonomous surface cleaning apparatus or wet cleaning robot according to a second embodiment of the invention, and showing a two-stage collection system of the robot.

FIG. 9 is a schematic view of a second embodiment of the robot 10. The second embodiment can be substantially the same as the first embodiment described with respect to FIGS. 1-8, and like elements are indicated with the same reference numerals. In the second embodiment, the robot 10 is configured to strain out debris of a certain size from the dirty liquid collected in the first collection area 44, and to pump the dirty liquid into the second collection area 48.

The first collection area 44 can be any type of collection area, cup, tray, bin, or tank suitable for the purposes described herein, including the collection of debris and liquid. The first collection area 44 can generally receive liquid and debris in the same manner as described above for the first embodiment. In the illustrated embodiment, the first collection area 44 comprises a receptacle 140 and a collection tray 142 configured to fit within the receptacle 140. The collection tray 142 includes a plurality of openings 144 and acts as a strainer to separate the dirty liquid from the debris. The collection tray 142 is configured to collect the debris, including hair, while draining liquid, and optionally some smaller-sized debris, into the receptacle 140 for eventual collection in the second collection area 48, as described in further detail below. The second collection area 48 can primarily collect liquid. Any debris collected in the second collection area 48 can be small enough to pass through the openings 144 in the collection tray 142, and so that openings 144 can be sized accordingly.

The receptacle 140 and collection tray 142 have a generally open tops aligned to defining an entrance opening 146 into a collection space or chamber 148 of the tray 142 and which is in fluid communication with the brush chamber 62. Debris and liquid that is scraped off the brushroll 30 by the scraper 52 can fall through the entrance opening 146 into the collection tray 142. Additionally, in some embodiments, liquid and debris can spin off the rotating brushroll 30 and fly backwards into the collection tray 142. The receptacle 140 and collection tray 142 can be elongated transversely, and can, for example be generally coextensive with the transverse length of the brushroll 30 and/or scraper 52.

Figure 10:
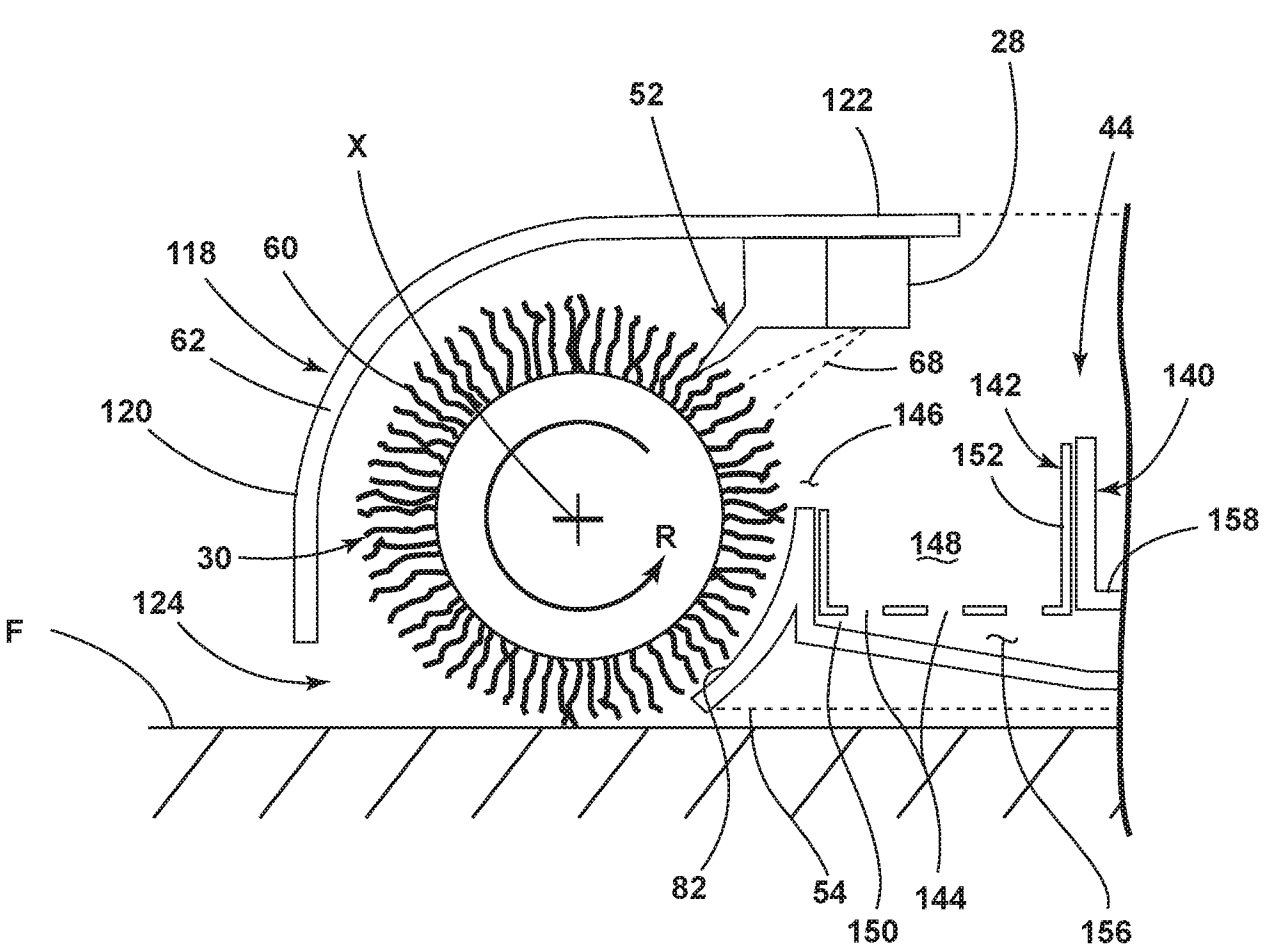
FIG. 10 is a view similar to FIG. 9, showing a close-up view of a brushroll, brush chamber, and first collection area.

In the illustrated embodiment as shown in FIG. 10, the collection tray 142 is rectilinear in shape, including a closed bottom wall 150 and a peripheral side wall 152 extending upwardly from the bottom wall 150. The peripheral side wall 152 can define the entrance opening 146.

The openings 144 can be formed in the bottom wall 150. Alternatively or additionally, openings can be formed in the side wall 152 as well. The openings 144 shown herein are circular holes through the bottom wall 150 of the tray 142. Other embodiments of openings are possible, including non-circular openings or apertures. Still further, other embodiments of the tray 142 can have a grid or mesh defining the openings 144.

The receptacle 140 can be provided as a removable or non-removable component on the housing 12. The collection tray 142 can be removable from the receptacle 140 for straining out the debris from dirty liquid, and thereafter emptying the debris still in the collection chamber 148.

Referring to FIG. 9, the second collection stage or suction collection system of the robot 10 includes a pump 154 in fluid communication with the receptacle 140 for directing liquid in the receptacle 140 to the second collection area 48. The receptacle 140 can include a sump 156 at a lower part thereof and an outlet 158 at the sump 156. The pump 154 is provided in the fluid pathway between the sump 156 and the second collection area 48 to control the flow of liquid and small debris from the receptacle 140 to the second collection area 48. A conduit, duct, tubing or hose 160 can fluidly couple the outlet 158 of the receptacle 140 with an inlet 162 of the pump 154. It is noted that the pump 154 can be a second pump on the robot 10, in addition to the pump 32 for the fluid delivery system (FIG. 1). In one example, the pump 154 can comprise a centrifugal pump with an impeller configured for pumping debris-laden fluids without clogging, such as a vortex impeller, shredder impeller, closed channel impeller, semi-open impeller, or other non-clogging impeller type, for example. In another example, the pump can comprise a gear pump.

The collection tray 142 can be configured to fit within the receptacle 140 with the bottom wall 150 spaced from a bottom of the receptacle 140 defining the sump 156. Liquid and small debris can pass through the drain openings 144 to the sump 156 below the bottom wall 150, while large debris are trapped within the tray 142. Optionally, the robot 10 can include a collection tray latch (not shown) for securing the collection tray 142 to the housing 12 or more specifically to the receptacle 140. The collection tray latch can be configured to releasably lock the collection tray 142 on the housing 12 or in the receptacle 140 so that that a user must actuate the latch before removing the collection tray 142. Alternatively, collection tray latch can be configured to releasably latch or retain, but not lock, the collection tray 142 on the housing 12 or in the receptacle 140, such that a user can conveniently apply sufficient force to the collection tray 142 itself to pull the collection tray 142 out of the receptacle 140.

The second collection area 48 can be any type of collection area, cup, tray, bin, or tank suitable for the purposes described herein, including the collection of debris and liquid. In the illustrated embodiment, the second collection area 48 comprises a recovery tank 164 for receiving liquid and small debris pumped from the receptacle 140. The recovery tank 164 can comprise a collection chamber in which the separated liquid and small debris are deposited. An outlet 166 of the pump 154 can be in fluid communication with an inlet 168 of the recovery tank 164, such as via a conduit, duct, tubing or hose 170.

Figure 11:
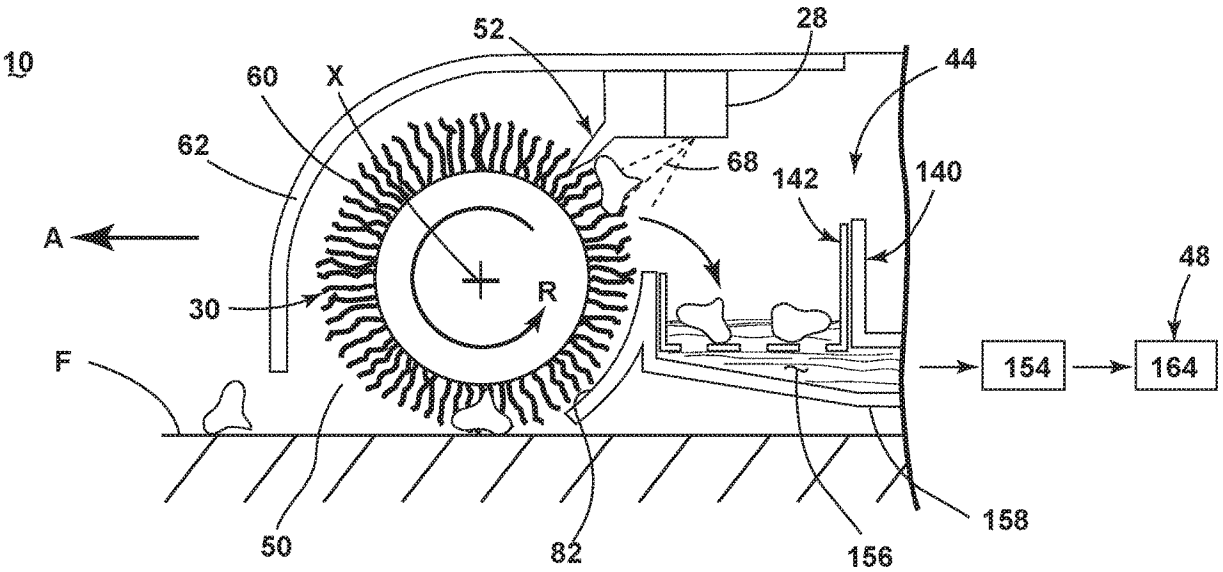
FIG. 11 is a view similar to FIG. 10, showing a wet cleaning or mopping operation of the robot.

During operation, the robot 10 moves autonomously over the floor surface F. Referring to FIG. 11, the robot 10 is depicted as autonomously moving in the direction indicated by arrow A, although other directions are possible. As shown in FIG. 11, in some cleaning operations, the robot 10 can be used to perform wet cleaning or mopping, in which liquid is applied to the brushroll 30 from the distributor 28. In this case, the wetted rotating brushroll 30 can mop the floor surface F, and can collect and move liquid and debris up the ramp 82 and into the collection tray 142. The scraper 52 mechanically removes additional debris from the brushroll 30, which falls into the collection tray 142. The scraper 52 also squeezes dirty liquid out of the brushroll 30 by mechanically compressing the brushroll 30, and particularly compressing the microfiber material 60. The pump 154 draws liquid from the sump 156 into the recovery tank 164.

Figure 12:
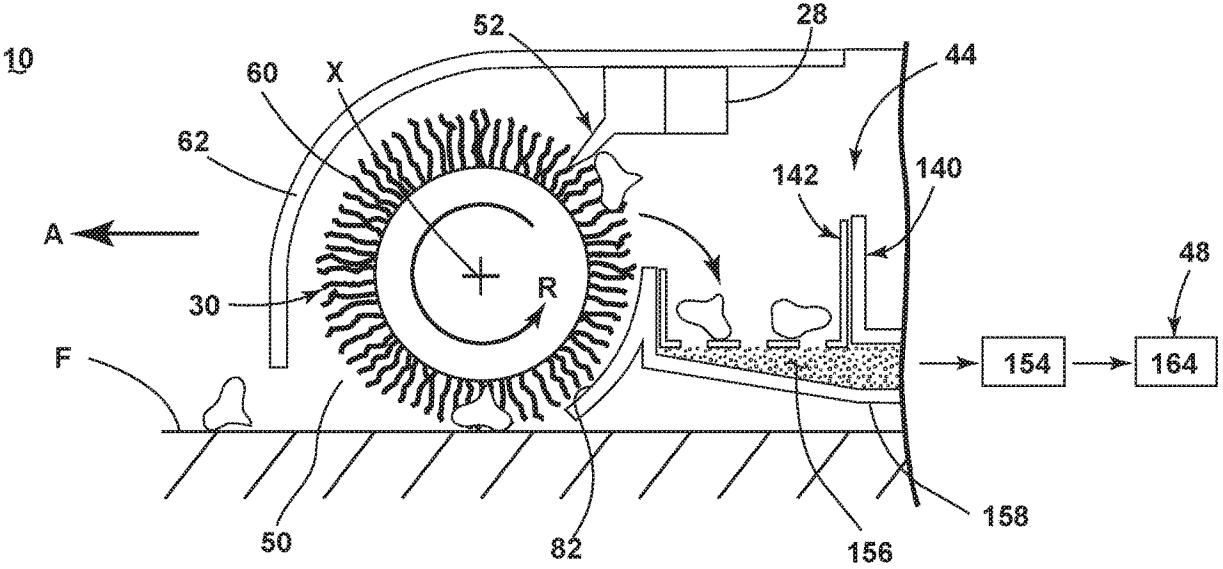
FIG. 12 is a view similar to FIG. 10, showing a dry cleaning or vacuuming operation of the robot.

Referring to FIG. 12, the robot 10 can be used to perform dry cleaning or sweeping, in which liquid is not applied from the distributor 28 and the floor surface F is otherwise relatively dry. In this case, the rotating brushroll 30 can sweep and/or agitate the floor surface F and can collect and move dry debris up the ramp 82 and into the collection tray 142. The scraper 52 mechanically removes additional debris from the brushroll 30, which falls into the collection tray 142. Any debris small enough to pass through the openings 144 in the collection tray 142 can be collected in the recovery tank 164.

After a wet or dry cleaning operation, the collection tray 142 can be removed from the receptacle 140. The debris collected therein can be disposed of in a trashcan, toilet, or other waste receptacle. The collection tray 142 can thereafter be reassembled to the robot 10 for further use. The recovery tank 164 can also be emptied at this time.

Alternatively, the robot 10 can have a disposable collection tray 142, and after a wet or dry cleaning operation, the disposable collection tray 142 can be removed from the receptacle 140, and the entire tray 142, including the debris collected therein, can be disposed of in a trash can, toilet, or other waste receptacle. This can help simplify the end-of-run maintenance process for a user. A new disposable collection tray 142 can thereafter be provided to the robot 10.

In an alternative embodiment, a suction nozzle and suction source as disclosed above for the first embodiment can be provided to the second embodiment of the robot 10 of FIGS. 9-12, in addition to the pump 154. In this case, two recovery tanks can be provided.

Figure 13:
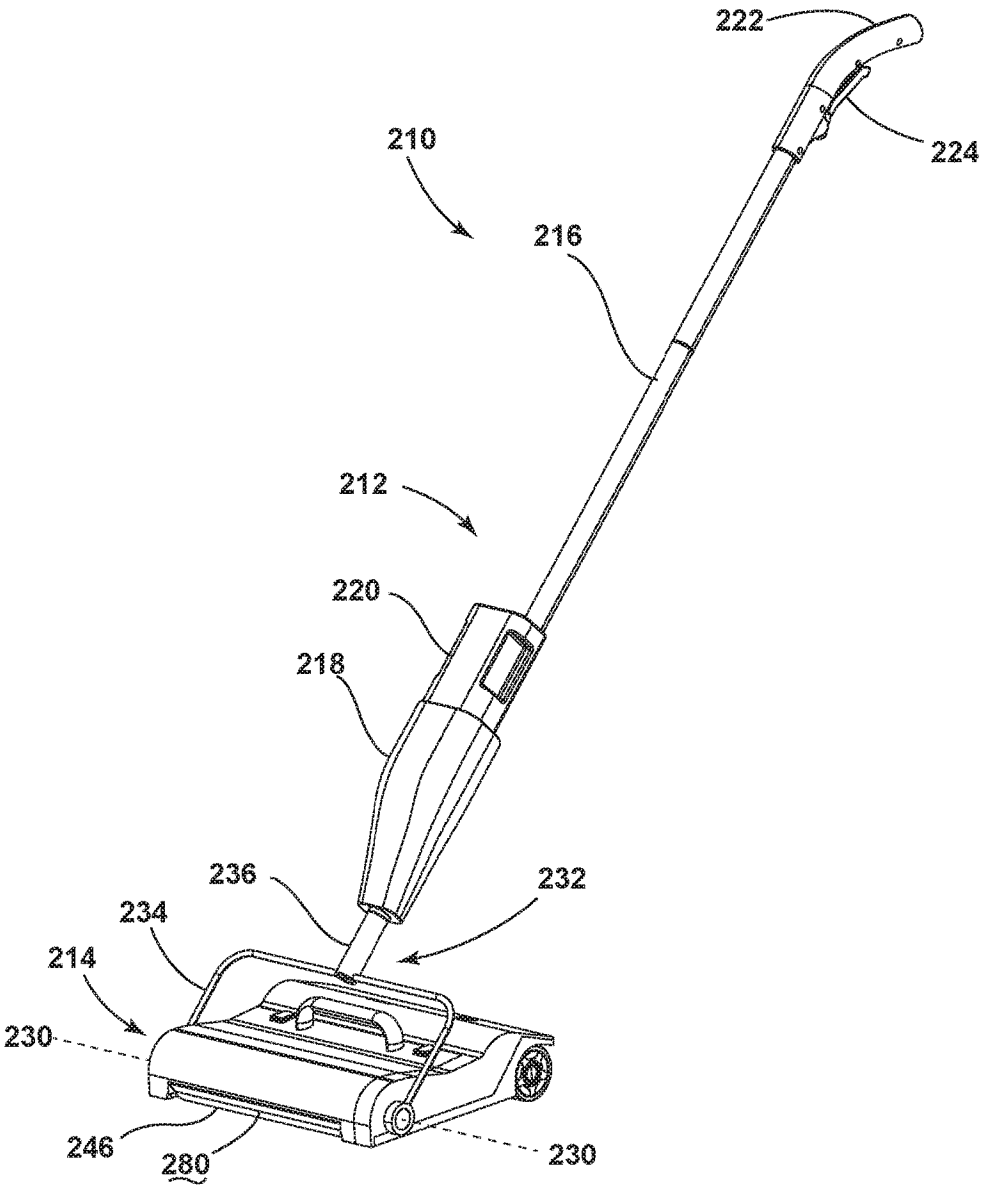
FIG. 13 is a perspective view of a surface cleaning apparatus in the form of a sweeper, according to a third embodiment of the invention.

FIG. 13 is a perspective view of a surface cleaning apparatus according to a third embodiment, shown as a sweeper and generally designated 210. As discussed in further detail below, the sweeper 210 is provided with various features and improvements, which are described in further detail below. As illustrated herein, the sweeper 210 can be an upright multi-surface sweeper having a housing that includes an upright handle assembly or body 212 and a cleaning foot or base 214 mounted to or coupled with the upright body 212 and adapted for movement across a surface to be cleaned. The sweeper 210 includes a fluid delivery system and a two-stage collection system, which are described in further detail below, and which can include components supported on either one or both of the body 212 and base 214.

The upright body 212 can comprise a handle 216 and a frame 218. The frame 218 can comprise a main support section supporting at least a supply tank 220, and may further support additional components of the body 212. The handle 216 can include a hand grip 222 and a trigger 224 mounted to the hand grip 222, which controls fluid delivery from the supply tank 220 via an electronic or mechanical coupling with the tank 220.

Figure 14:
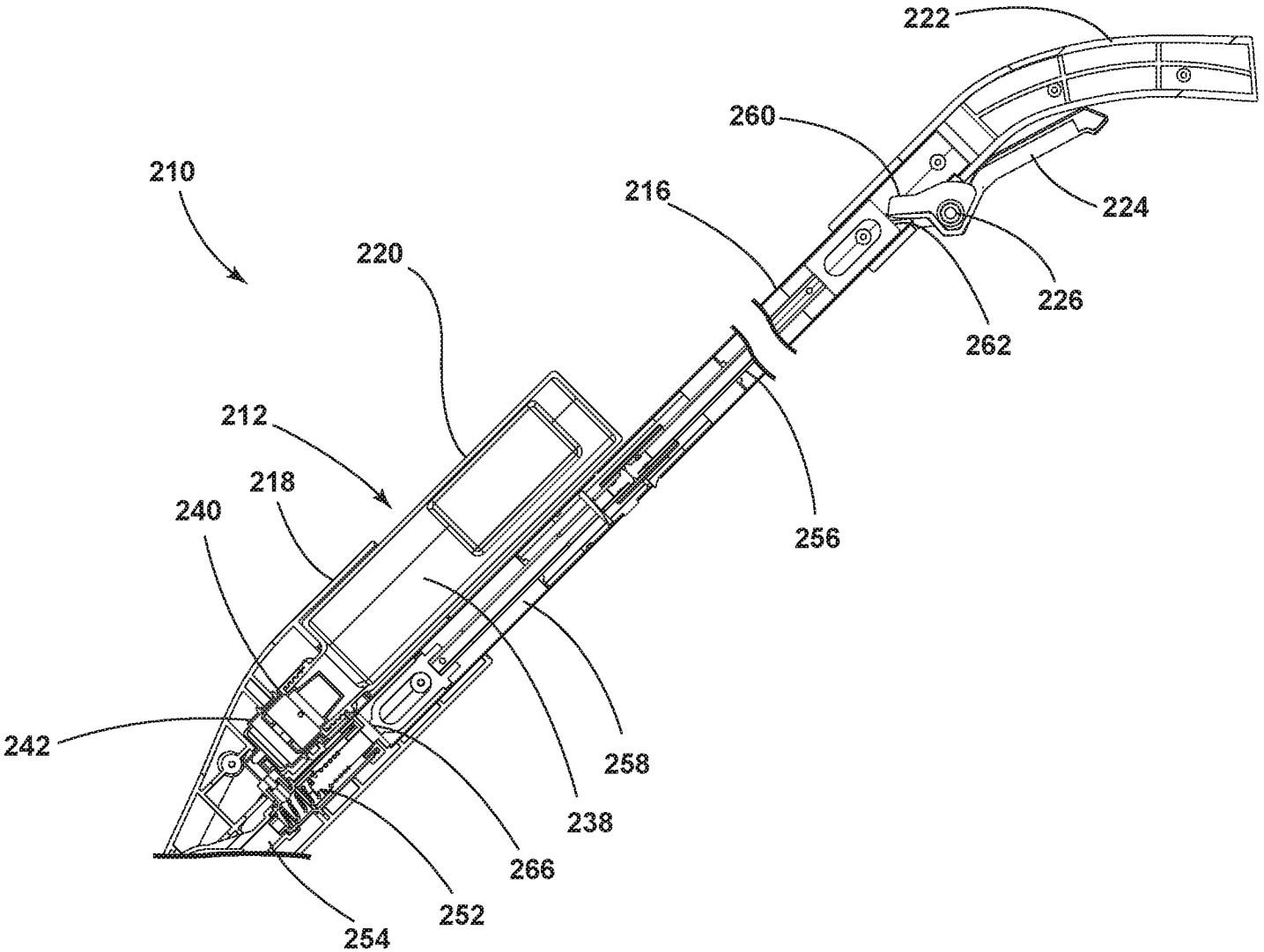
FIG. 14 is a cross-sectional view of a portion of an upright body and handle of the sweeper from FIG. 13.

With additional reference to FIG. 14, the trigger 224 can project at least partially exteriorly of the hand grip 222 for user access. The trigger 224 can rotate about a pivot 226, and can be biased outwardly from the hand grip 222 as described in further detail below. Other actuators, such as a thumb switch, can be provided instead of the trigger 224.

The upright body 212 can comprise any type of elongated handle or body suitable for the purposes described herein and can be adapted to pivot about one or more axes. For example, the upright body 212 can be pivoted about a pivot axis 230 through a range of angles relative to the surface to be cleaned. The pivot axis 230 can lie substantially parallel to the surface to be cleaned, and can extend transversely or laterally through the base. Optionally, the upright body 212 can be configured to swivel about its longitudinal axis in addition to pivoting about the pivot axis 230.

In the embodiment shown, the upright body 212 can be pivotally attached to the base 214 for rotation about the pivot axis 230 by a moveable joint assembly 232. The joint assembly 232 can be formed at a lower end of the frame 218 and moveably mounts the base 214 to the upright body 212. In the embodiment shown herein, the upright body 212 can pivot up and down about at least the pivot axis 230 relative to the base 214. The joint assembly 232 can include a yoke 234 pivotally connected on opposing lateral sides of the base 214, with said pivotal connection defining the pivot axis 230. The yoke 234 is further fixed with the upright body 212, either directly or via an extension 236 on a lower end of the upright body 212, which can particularly extend from a lower end of the frame 218. In another embodiment, the joint assembly 232 can alternatively comprise a universal joint, such that the upright body 212 can pivot about at least two axes relative to the base 214.

Figure 15:
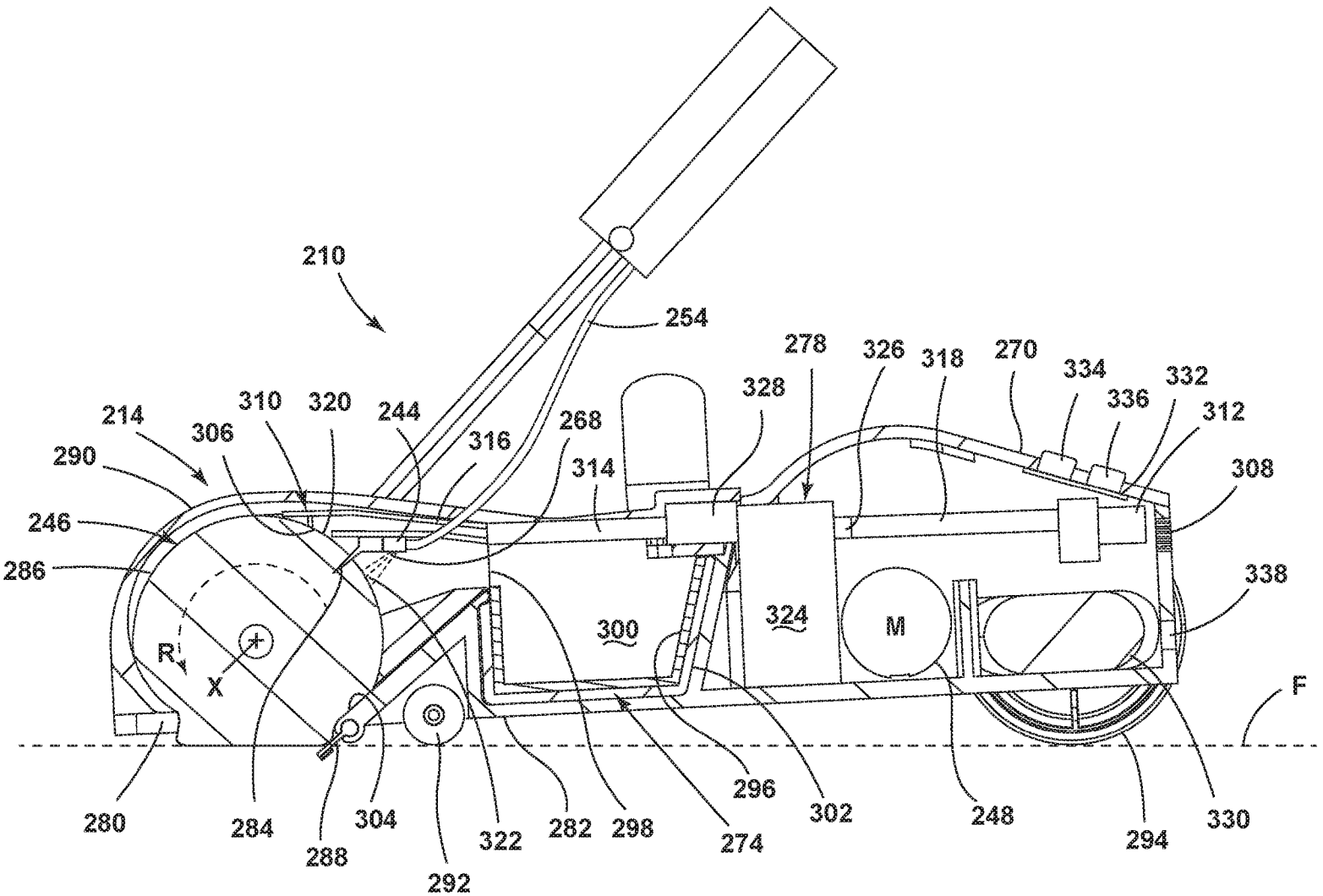
FIG. 15 is a cross-sectional view of the base of the sweeper from FIG. 13.

With reference to FIGS. 14-15, the fluid delivery system can include a supply tank 220 for storing a supply of cleaning fluid and at least one fluid distributor 244 in fluid communication with the supply tank 220. The cleaning fluid can be a liquid such as water or a cleaning solution specifically formulated for hard surface cleaning.

The supply tank 220 can be provided on the upright body 212. The supply tank 220 can be mounted to the frame 218 in any configuration. In the present embodiment, the supply tank 220 can be removably mounted at the front of the frame 218 such that the supply tank 220 partially rests in the upper front portion of the frame 218 and partially against the handle 216, and can be removable from the frame 218 for filling or refilling.

The supply tank 220 includes at least one supply chamber 238 for holding cleaning fluid and a supply valve assembly 240 controlling fluid flow through an outlet of the supply chamber 238. Alternatively, the supply tank 220 can include multiple supply chambers, such as one chamber containing water and another chamber containing a cleaning agent. For a removable supply tank 220, the supply valve assembly 240 can mate with a valve receiver 242 on the frame 218 and can be configured to automatically open when the supply tank 220 is seated on the frame 218 to release fluid to the fluid delivery pathway.

The fluid distributor 244 can be positioned to dispense cleaning fluid onto the surface to be cleaned, either directly onto the surface to be cleaned, such as by having an outlet of the fluid distributor 244 positioned in opposition to the surface, or indirectly onto the surface to be cleaned, such as by having an outlet of the fluid distributor 244 positioned to dispense onto a an agitator such as a brushroll 246. In the illustrated embodiment, the fluid distributor 244 is positioned to dispense cleaning fluid onto the brushroll 246. Alternatively, the fluid distributor 244 can be configured for spraying directly onto a floor over which the base 214 moves, and can in particular dispense cleaning fluid beneath the base 214 or can dispense cleaning fluid outwardly from the base 214 so that the user can see exactly where cleaning fluid is being dispensed. For example, the fluid distributor 244 can dispense cleaning fluid forwardly, rearwardly, laterally, or anywhere outward from the base 214. As yet another alternative, multiple fluid distributors can be provided for dispense cleaning fluid onto the brushroll 246 and directly onto a floor. In other embodiments, the fluid distributor 244 can be provided on the upright body 212 and can be configured to deliver cleaning fluid to the surface to be cleaned directly by spraying outwardly and forwardly in front of the base 214.

The fluid delivery system can further comprise a flow control system for controlling the flow of fluid from the supply tank 220 to the fluid distributor 244. In one configuration, the flow control system can comprise a pump 252 that pressurizes the system. The trigger 224 can be operably coupled with the flow control system such that pressing the trigger 224 will deliver fluid from the fluid distributor 244. The pump 252 can be positioned within the frame 218 and is in fluid communication with the supply tank 220 via the valve assembly 240.

A fluid supply conduit 254 fluidly connects an outlet of the pump 252 with an inlet of the fluid distributor 244. Optionally, the fluid supply conduit 254 can pass exteriorly or interiorly within the frame 218 and/or the joint assembly 232. In another embodiment, the pump 252 can be provided in the base 214, with a fluid supply conduit passing exteriorly or interiorly within the frame 218 and/or the joint assembly 232 to fluidly connect the supply tank 220 to the pump 252. The conduit 254 can be one continuous conduit or be composed of multiple segments of conduits fluidly coupled together.

The pump 252 can be selectively actuated by the trigger 224. In one embodiment, the trigger 224 is operably connected to a push rod 256, which is in turn in register with the pump 252. As shown, the push rod 256 can be slidably mounted within the handle 216. The push rod 256 can move linearly or slide within a cavity 258 formed within the handle 216, which can be tubular or otherwise formed with a hollow interior space defining the cavity 258 for receiving the push rod. 256. It is noted that the handle 216 and the push rod 256 can be monolithic or one-piece components, or made from multiple pieces or segments coupled together.

The trigger 224 can have a trigger arm 260 within the hand grip 222 that is in register with an upper end 262 of the push rod 256. Pressing a portion of the trigger 224 external to the hand grip 222 rotates the entire trigger 224 about the pivot 226, including the trigger arm 260, which is levered against the upper end 262 of the push rod 256 to force the push rod 256 downwardly within the handle 216 or toward the pump 252.

A lower end 266 of the push rod 256 is in register with a portion of the pump 252. Movement of the lower end lower end 266 of the push rod 256 against the pump 252 actuates the pump 252 to deliver cleaning fluid to the distributor 244. In one example, the pump 252 can be a positive displacement pump, such as a piston pump. In another example, the pump 252 can be a centrifugal pump.

In operation, when the trigger 224 is depressed, the trigger arm 260 pushes the upper end 262 of the push rod 256, which slides downwardly within the handle 216. The lower end 266 of the push rod 256 actuates the pump 252. The pump 252 forces the cleaning fluid through the fluid supply conduit 254 and through the distributor 244, where a spray 268 of cleaning fluid is delivered onto the brushroll 246. The push rod 256 can further be biased to slide upwardly when the trigger 224 is released.

In another embodiment, the pump 252 can be an electrically-actuated pump, such as, but not limited to, a solenoid pump having a single, dual, or variable speed. In such an embodiment, the push rod 256 can have one end in register with a switch that activates the pump 252. Alternatively, the push rod 256 can be eliminated, and the trigger 224 can be electronically coupled with a switch and a printed circuit board (PCB) configured to control the duty cycle of the pump 252.

In another configuration of the fluid supply pathway, the pump 252 can be eliminated and the flow control system can comprise a gravity-feed system having a valve fluidly coupled with an outlet of the supply tank 220, whereby when valve is open, fluid will flow under the force of gravity to the fluid distributor 244. The valve can be mechanically actuated, such as by providing the push rod 256 with one end in register with the valve, such that pressing the trigger 224 forces the push rod 256 to open the valve.

Optionally, a heater (not shown) can be provided for heating the cleaning fluid prior to delivering the cleaning fluid to the surface to be cleaned. In one example, an in-line heater can be located downstream of the supply tank 220, and upstream or downstream of the pump 252 or other flow control system. Other types of heaters can also be used.

Referring to FIG. 15, the base 214 can include a base housing 270 supporting at least some of the components of the fluid delivery and collection systems, including the brushroll 246. A brush motor 248 can be provided within the base housing 270 to drive the brushroll 246. A drive transmission (not shown), for example including a belt, operably connects a motor shaft of the motor 248 with the brushroll 246 for transmitting rotational motion of the motor shaft to the brushroll 246. Alternatively, the brushroll 246 can be driven mechanically by the movement of the base 214 over the floor surface F.

The two-stage collection system of the sweeper 210 shown includes a first collection stage or mechanical collection system for mechanically removing liquid and debris from the brushroll 246 and storing the liquid and debris onboard the base housing 270 in a first collection area 274, and a second collection stage or suction collection system for suctioning liquid and debris from the brushroll 246 and storing the liquid and debris in a second collection area 278. In the illustrated embodiment, the second collection area 278 is provided on the base housing 270; alternatively, the second collection area 278 can be provided on the upright body 212.

The base housing 270 can include an inlet opening 280. The inlet opening 280 can be provided on a lower side 282 of the base housing 270 adapted to be adjacent the surface to be cleaned or floor surface F as the base housing 270 moves across a floor. The brushroll 246 can be provided adjacent to the inlet opening 280 for sweeping, agitating, and/or mopping the floor surface F, as described in more detail below.

In addition to the brushroll 246, the mechanical collection system can include a scraper 284 configured to interface with a portion of the brushroll 246 to scrape liquid and debris off the brushroll 246, and the first collection area 274, which receives the liquid and debris mechanically scraped off the brushroll 246 by the scraper 284. In addition, in some embodiments of the sweeper 210, some debris and/or liquid swept up by the rotating brushroll 246 can be mechanically propelled directly into the first collection area 274, i.e. without being scraped off by the scraper 284. The fluid distributor 244 can be positioned inside the base 214 and configured for spraying directly onto the brushroll 246. The brushroll 246 can be provided at a forward portion of the base 214 and received in a brush chamber 286 on the base 214. The brushroll 246 can be mounted for rotational movement in a direction R about a central rotational axis X.

Optionally, a squeegee 288 is mounted to the base housing 270, behind the brushroll 246, and is configured to contact the surface as the base 214 moves across the surface to be cleaned. The squeegee 288 can be pliant, i.e. flexible or resilient, in order to bend readily according to the contour of the surface to be cleaned and/or the brushroll 246, yet remain undeformed by normal use of the sweeper 210. Optionally, the squeegee 288 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the sweeper 210. It is noted that FIG. 15 shows the squeegee 288 unbent, whereas in operation, the squeegee 288 may be bent backward or forward where it engages the floor surface F, depending on the direction of movement of the sweeper 210.

The structure and function of the brushroll 246, brush chamber 286, scraper 284, and fluid distributor 244 can be the same as, or substantially similar to, that described above for the brushroll 30, brush chamber 62, scraper 52, and fluid distributor 28 of the previous embodiments, including that the brushroll 246 can comprise the hybrid brushroll of FIG. 3, and that the brush chamber 286 can be defined by a cover 290 provided on the base housing which can be the same as, or substantially similar to, cover 118, among other embodiments.

Wheels can be provided on the base housing 270 for moving the sweeper 210 over the surface to be cleaned, and optionally can include a pair of front wheels 292 and a pair of rear wheels 294. The rear wheels 294 can be provided on rearward portion of the base housing 270, rearward of components such as the brushroll 246 and first collection area 274.

The first collection area 274 can be any type of collection area, cup, tray, bin, or tank suitable for the purposes described herein, including the collection of debris and liquid. In the illustrated embodiment, the first collection area 274 comprises a collection tray 296 that has a generally open top defining an entrance opening 298 into a collection space or chamber 300 of the tray 296 and which is in fluid communication with the brush chamber 286. Debris and liquid that is scraped off the brushroll 246 by the scraper 284 can fall through the entrance opening 298 into the collection tray 296. Additionally, in some embodiments, liquid and debris can spin off the rotating brushroll 246 and fly backwards into the collection tray 296. The structure and function of the tray 296 can be the same as, or substantially similar to, that described above for the tray 70.

The collection tray 296 can be removable from the base 214 for emptying. The base 214 can include a collection tray receiver 302 for receiving the collection tray 296. The collection tray 296 can slide into or otherwise be seated in the collection tray receiver 302 to install the collection tray 296 on the base 214. In one embodiment, the collection tray 296 can be removed through one of the lateral sides of the base 214 for emptying. In other embodiments, the collection tray 296 can be removed from the bottom of the base 214 or from the top of the base 214. Optionally, the sweeper 210 can include a collection tray latch (not shown) for securing the collection tray 296 to the base 214.

As disclosed above, the brushroll 246 can be provided adjacent to the inlet opening 280 for sweeping, agitating, and/or mopping the floor surface F. A ramp 304 can be provided at a rear portion of the brush chamber 286 to help move debris and liquid upward to the entrance opening 298 and into the collection chamber 300, and can be the same as, or substantially similar to, the ramp 82 described above for the first embodiment.

The suction collection system can include an extraction path through the base 214 having a dirty inlet 306 and a clean air outlet 308, an extraction or suction nozzle 310 which is positioned to confront the brushroll 246, a suction source or vacuum motor 312 in fluid communication with the suction nozzle 310 for generating a working air stream, and the second collection area 278 which receives liquid and debris suctioned off the brushroll 246 by the suction nozzle 310.

The vacuum motor 312 is in fluid communication with the suction nozzle 310 and the second collection area 278 for generating a working air stream through the extraction path. The vacuum motor 312 can be carried by the base 214, fluidly upstream of the air outlet 308, and can define a portion of the extraction path. Alternatively, the vacuum motor 312 can be carried by the upright body 212. Optionally, the suction collection system can be provided with one or more additional filters upstream or downstream of the vacuum motor 312, such as a pre-motor filter and/or a post-motor filter (not shown).

The suction nozzle 310 removes liquid and debris from the brushroll 246, rather than the floor surface F, and defines the dirty inlet 306, also referred to herein as suction nozzle inlet 306. The structure and function of the suction nozzle 310 can be the same as, or substantially similar to, the structure and function of the suction nozzle 88 described above for the first embodiment. A conduit, duct, tubing or hose 314 can fluidly couple an outlet 316 of the suction nozzle 310 with the second collection area 278. The suction collection system can be provided with various other conduits, ducts, tubing and/or hoses fluidly coupling components of the suction collection system together, including a second conduit, duct, tubing or hose 318 fluidly coupling an air outlet opening of the second collection area 278 with the vacuum motor 312.

The fluid distributor 244, scraper 284, and suction nozzle 310 can be positioned relative to each other such that the suction nozzle 310 remove liquid and debris from a portion brushroll 246 past where the scraper 284 interfaces with the brushroll 246 and where fluid is sprayed onto the brushroll 246. In particular, the suction nozzle 310 can be disposed to engage the brushroll 246 at a portion 320 just past a portion 322 of the brushroll 246 engaged by the scraper 284, as defined by the direction of rotation R of the brushroll 246 about brush rotational axis X. Starting with a portion of the rotating brushroll 246 in contact with the floor surface F, in operation that portion rotates up the ramp 304, is optionally wetted by the fluid distributor 244, scraped by the scraper 284, and suctioned by the suction nozzle 310 before rotating back into contact with the floor surface F. The scraper 284 tends to remove larger or coarser debris from the brushroll 246, while finer debris is removed by the suction nozzle 310. Accordingly, larger or coarser debris may typically be collected in the first collection area 274, while finer debris may typically be collected in the second collection area 278.

The second collection area 278 can be any type of collection area, cup, tray, bin, or tank suitable for the purposes described herein, including the collection of debris and liquid. In the illustrated embodiment, the second collection area 278 comprises a recovery tank 324 for collecting liquid and debris from the working airstream for later disposal. The structure and function of the recovery tank 324 can be the same as, or substantially similar to, the structure and function of the recovery tank 108 described above for the first embodiment. The vacuum motor 312 can be in fluid communication with an air outlet 326 of the recovery tank 324, such as via conduit 314 as described above. An inlet 328 of the recovery tank 324 can be in fluid communication with the suction nozzle 310, such as via conduit 314 as described above. Optionally, the sweeper 210 can include a recovery tank latch (not shown) for securing the recovery tank 324 to the base 214.

The sweeper 210 can be cordless or battery powered. In the illustrated embodiment, a rechargeable battery 330 (e.g. a battery pack or a plurality of battery cells) is provided for cordless operation. In one example, the battery 330 can be a lithium ion battery. In another exemplary arrangement, the battery 330 can comprise a user replaceable battery. In an alternative embodiment, the sweeper 210 can have a power cord configured to be plugged into a household outlet for powering the electronic components of the sweeper 210. The battery 330 can be provided at various locations on the sweeper 210, such as in the base 214 or on the upright body 212, such as within the frame 218. In the illustrated embodiment, the battery 330 is mounted within the base 214.

The sweeper 210 can further include a controller 332 operably coupled with the various function systems of the sweeper 210 for controlling its operation, such as being operably coupled with the brush motor 248 to provide brush motor control, the vacuum motor to provide vacuum motor control, and the battery 330 for controlling a battery charging operation. The controller 332 can be a microcontroller unit (MCU) that contains at least one central processing unit (CPU). The controller 332 can be provided at various locations on the sweeper 210, and in the illustrated embodiment is located in the base 214, within the base housing 270. Alternatively, the controller 332 can be provided on the upright body 212, such as within the frame 218.

The brush motor 248 can be selectively energized by a brush power switch 334 and the vacuum motor 312 can be selectively energized by a vacuum power switch 336. The power switches 334, 336 can be located on the base 214, although other locations are possible. With the power switches 334, 336 located on the base 214, the switches 334, 336 can conveniently be actuated by a user's foot to turn the motors 248, 312 on and off, individually. Regardless of location, the switches 334, 336 can be operated independently of the trigger 224 (FIG. 13) so that cleaning fluid can be dispensed and suctioned when the brushroll 246 is rotating for simultaneous wet mopping and vacuuming, the brushroll 246 can be turned off while still dispensing cleaning fluid via the trigger 224 for a wet mopping-only mode, or the brushroll 246 and vacuum motor 312 can be turned on while not dispensing cleaning fluid for a dry vacuuming-only mode. Alternatively, the sweeper 210 can have a single power switch with energizes both motors 248, 312.

In embodiments where the sweeper 210 has a rechargeable battery 330, an appropriate charger can be provided with the sweeper 210. In one embodiment, the sweeper 210 can have a USB charging port 338 that can be used to charge the battery 330. A USB charging cable (not shown) can be provided for plugging the sweeper 210 into a household outlet. As shown herein, the USB charging port 338 can be provided on the base 214 and is accessible to a user from the exterior of the sweeper 210. Alternatively, the USB charging port 338 can be provided on the upright body 212, such as on the handle 216 or frame 218. In an alternative embodiment, the sweeper 210 can have charging contacts on the base 214, and a docking station (not shown) can be provided for receiving the sweeper 210 for recharging the battery 330 can be provided.

In some cleaning operations, the sweeper 210 can be used to perform wet cleaning or mopping, in which liquid is applied to the brushroll 246 from the distributor 244. In this case, the wetted rotating brushroll 246 can mop the floor surface F, and can collect and move liquid and debris up the ramp 304 and into the collection chamber 300. The scraper 284 mechanically removes additional debris from the brushroll 246, which falls into the collection tray 296. The scraper 284 also squeezes dirty liquid out of the brushroll 246 by mechanically compressing the brushroll 246. After passing the scraper 284, the suction nozzle 310 removes additional liquid and debris from the brushroll 246, which is collected in the recovery tank 324.

The sweeper 210 can also be used to perform dry cleaning or vacuuming, in which liquid is not applied from the distributor 244 and the floor surface F is otherwise relatively dry. In this case, the rotating brushroll 246 can sweep and/or agitate the floor surface F and can collect and move dry debris up the ramp 304 and into the collection chamber 300. The scraper 284 mechanically removes additional debris from the brushroll 246, which falls into the collection tray 296. After passing the scraper 284, the suction nozzle 310 removes additional debris from the brushroll 246, which is collected in the recovery tank 324.

After a wet or dry cleaning operation, the collection tray 296 can be removed from the tray receiver 302. The debris and/or liquid collected therein can be disposed of in a trashcan, toilet, or other waste receptacle. The collection tray 296 can thereafter be reassembled to the base 214 for further use. The recovery tank 324 can also be emptied at this time.

Alternatively, the sweeper 210 can have a disposable collection tray 296, and after a wet or dry cleaning operation, the disposable collection tray 296 can be removed from the receiver 302, and the entire tray 296, including the debris collected therein, can be disposed of in a trash can, toilet, or other waste receptacle. This can help simplify the end-of-run maintenance process for a user. A new disposable collection tray 296 can thereafter be provided to the sweeper 210.

Figure 16:
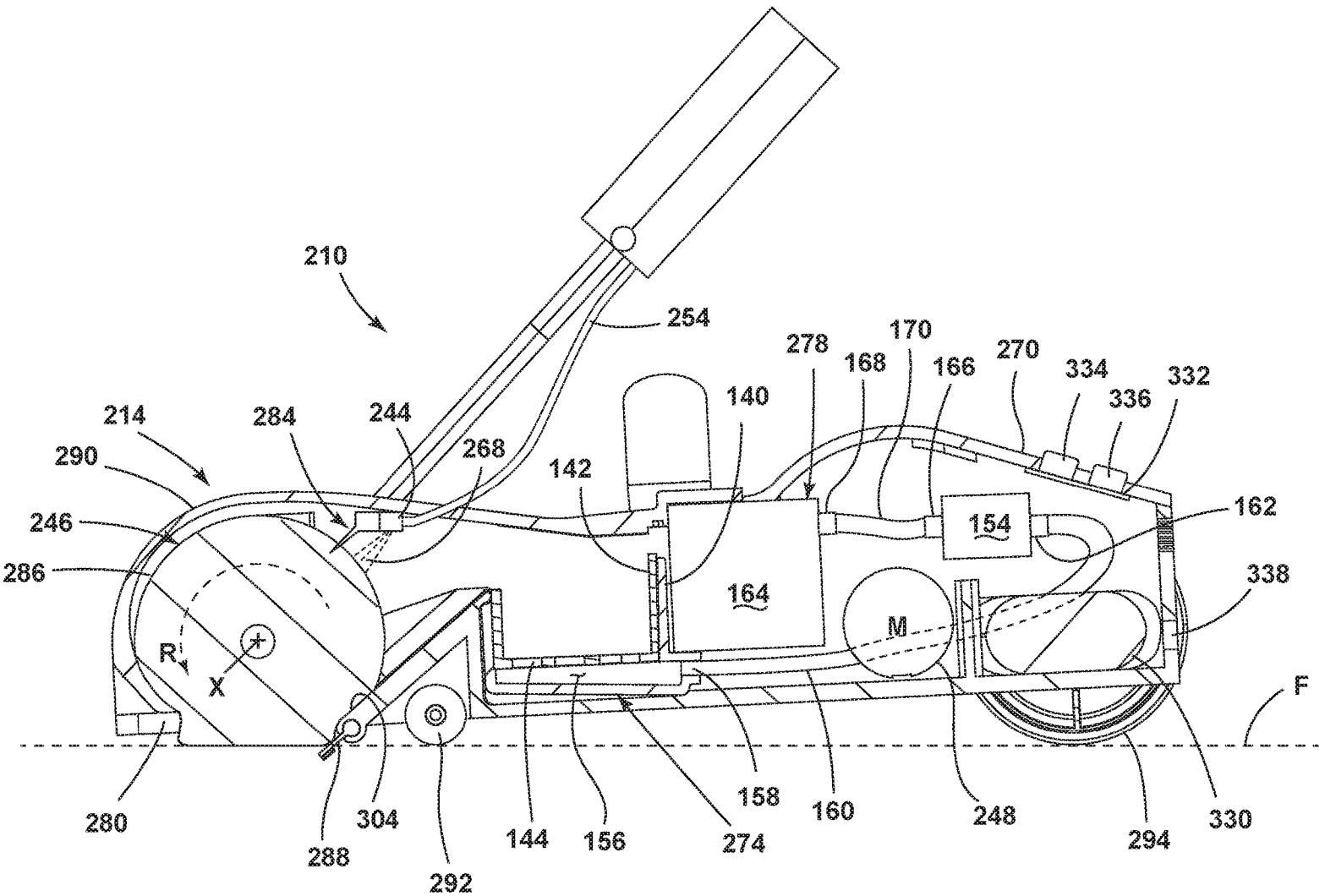
FIG. 16 is a cross-sectional view of a base of a surface cleaning apparatus in the form of a sweeper, according to a fourth embodiment of the invention.

FIG. 16 is a schematic view of another embodiment of the sweeper 210. This embodiment of the sweeper 210 is substantially the same as the embodiment described with respect to FIGS. 13-15 save for having a two-stage collection system substantially the same as the embodiment described with respect to FIGS. 9-12, and like elements are indicated with the same reference numerals. In this embodiment, the sweeper 210 is configured to strain out debris of a certain size from the dirty liquid collected in the first collection area 274, and to pump the dirty liquid into the second collection area 278 in a similar manner as the second embodiment described with respect to FIGS. 9-12, and comprises, among other elements of the collection system described with respect to FIGS. 9-12, the receptacle 140, the collection tray 142 with the plurality of openings 144 to act as a strainer to separate the dirty liquid from the debris, and the pump 154 in fluid communication with the receptacle 140 for directing liquid in the receptacle 140 to the second collection area 278. The pump 154 can be selectively energized by a pump power switch 340. Alternatively, the sweeper 210 can have a single power switch with energizes both the brush motor 348 and the pump 154.

In some cleaning operations, the sweeper 210 can be used to perform wet cleaning or mopping, in which liquid is applied to the brushroll 246 from the distributor 244. In this case, the wetted rotating brushroll 246 can mop the floor surface F, and can collect and move liquid and debris up the ramp 304 and into the collection tray 142. The scraper 284 mechanically removes additional debris from the brushroll 246, which falls into the collection tray 142. The scraper 284 also squeezes dirty liquid out of the brushroll 246 by mechanically compressing the brushroll 246. The pump 154 draws liquid from the sump 156 into the recovery tank 164.

The sweeper 210 can also be used to perform dry cleaning or vacuuming, in which liquid is not applied from the distributor 244 and the floor surface F is otherwise relatively dry. In this case, the rotating brushroll 246 can sweep and/or agitate the floor surface F and can collect and move dry debris up the ramp 304 and into the collection tray 142. The scraper 284 mechanically removes additional debris from the brushroll 246, which falls into the collection tray 142. Any debris small enough to pass through the openings 144 in the collection tray 142 can be collected in the recovery tank 164.

After a wet or dry cleaning operation, the collection tray 142 can be removed from the receptacle 140. The debris collected therein can be disposed of in a trashcan, toilet, or other waste receptacle. The collection tray 142 can thereafter be reassembled to the sweeper 210 for further use. The recovery tank 164 can also be emptied at this time.

Alternatively, the sweeper 210 can have a disposable collection tray 142, and after a wet or dry cleaning operation, the disposable collection tray 142 can be removed from the receptacle 140, and the entire collection tray 142, including the debris collected therein, can be disposed of in a trash can, toilet, or other waste receptacle. This can help simplify the end-of-run maintenance process for a user. A new disposable collection tray 142 can thereafter be provided to the sweeper 210.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples. Any reference to elements in the singular, for example, using the articles "a," "an," "the," or "said," is not to be construed as limiting the element to the singular.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus, comprising:

a two-stage collection system, comprising:

a mechanical collection stage comprising an agitator rotatably driven about a rotational axis, a scraper interfacing with a first portion of the agitator, and a first collection area configured to collect debris and liquid mechanically propelled into the first collection area by the agitator and mechanically scraped off the agitator by the scraper; and a suction collection stage comprising a suction nozzle proximate the agitator and a suction source in fluid communication with the suction nozzle to recover debris and liquid on the agitator in a second collection area;

wherein the suction nozzle confronts a second portion of the agitator, the second portion of the agitator being disposed past the first portion of the agitator in a direction of rotation of the agitator about the rotational axis.

2. The surface cleaning apparatus of claim 1, comprising an inlet opening in a housing of the surface cleaning apparatus, wherein the agitator is rotatably mounted in the inlet opening to contact a surface to be cleaned below the housing, and a ramp extending upwardly from a rear side of the inlet opening to an entrance opening into the first collection area, wherein the suction nozzle is disposed away from the inlet opening and above the ramp.

3. The surface cleaning apparatus of claim 1, wherein the first collection area comprises a collection tray having an entrance opening into a collection chamber of the collection tray, the entrance opening being open to a chamber in which the agitator is rotatably mounted.

4. The surface cleaning apparatus of claim 3, comprising a collection tray receiver in a housing of the surface cleaning apparatus, wherein the collection tray is removable from the collection tray receiver to empty debris and liquid collected therein.

5. The surface cleaning apparatus of claim 1, wherein the first collection area comprises a disposable collection tray and a collection tray receiver in a housing of the surface cleaning apparatus, the collection tray being removable from the collection tray receiver for disposal of the collection tray along with any debris and liquid collected therein.

6. The surface cleaning apparatus of claim 1, wherein the second collection area comprises a recovery tank and the suction source comprises a vacuum motor in fluid communication with an outlet of the recovery tank, wherein an inlet of the recovery tank is in fluid communication with the suction nozzle.

7. The surface cleaning apparatus of claim 1, comprising a fluid delivery system including a fluid supply tank and a fluid distributor positioned to dispense cleaning fluid onto the agitator.

8. The surface cleaning apparatus of claim 7, wherein the fluid distributor is positioned proximate the scraper to wet the first portion of the agitator prior to rotation of the first portion of the agitator past the scraper.

9. The surface cleaning apparatus of claim 1, wherein the agitator comprises a microfiber material, and the scraper is configured to compress the microfiber material and squeeze liquid out from the microfiber material.

10. The surface cleaning apparatus of claim 1, comprising a battery powering the suction source and a motor driving the agitator.

11. The surface cleaning apparatus of claim 1, comprising an autonomously moveable housing and an autonomous drive system.

12. A surface cleaning apparatus, comprising:

a two-stage collection system, comprising:

a mechanical collection stage comprising an agitator rotatably driven about a rotational axis and a first collection area configured to collect debris and liquid from the agitator; and a suction collection stage comprising a second collection area and a pump having an inlet in fluid communication with the first collection area and an outlet in fluid communication with the second collection area;

wherein the second collection area comprises a recovery tank, and the outlet of the pump is in fluid communication with an inlet of the recovery tank to pump dirty liquid from the first collection area into the recovery tank.

13. The surface cleaning apparatus of claim 12, wherein the mechanical collection stage comprises a scraper interfacing with a first portion of the agitator, and the first collection area is configured to collect debris and liquid mechanically propelled into the first collection area by the agitator and mechanically scraped off the agitator by the scraper.

14. The surface cleaning apparatus of claim 13, comprising an inlet opening in a housing of the surface cleaning apparatus, wherein the agitator is rotatably mounted in the inlet opening to contact a surface to be cleaned below the housing, and a ramp extending upwardly from a rear side of the inlet opening to an entrance opening into the first collection area, wherein the scraper is disposed away from the inlet opening and above the ramp.

15. The surface cleaning apparatus of claim 12, wherein the first collection area comprises a collection tray having an entrance opening into a collection chamber of the collection tray, the entrance opening being open to a chamber in which the agitator is rotatably mounted.

16. The surface cleaning apparatus of claim 12, wherein the first collection area comprises a strainer to separate collected liquid from collected debris and a sump below the strainer, wherein the pump in fluid communication with the sump.

17. The surface cleaning apparatus of claim 12, wherein the first collection area comprises a receptacle and a collection tray configured to fit within the receptacle, the collection tray comprising a plurality of liquid drain openings, the collection tray being removable from the receptacle for disposal of any debris collected therein.

18. The surface cleaning apparatus of claim 12, comprising a fluid delivery system including a fluid supply tank and a fluid distributor positioned to dispense cleaning fluid onto the agitator.

19. The surface cleaning apparatus of claim 12, comprising an autonomously moveable housing and an autonomous drive system.

20. The surface cleaning apparatus of claim 12, wherein the outlet of the pump is in fluid communication with the inlet of the recovery tank via at least one of a conduit, a duct, a tubing, or a hose.

* * * * *